US006496673B2

(12) United States Patent
Bessho

(10) Patent No.: US 6,496,673 B2
(45) Date of Patent: Dec. 17, 2002

(54) IMAGE FORMING APPARATUS CAPABLE OF PREVENTING DAMAGE TO A PHOTOSENSITIVE BODY BY CHARGING PARTICLES

(75) Inventor: Yuji Bessho, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/862,586

(22) Filed: May 23, 2001

(65) Prior Publication Data

US 2001/0051061 A1 Dec. 13, 2001

(30) Foreign Application Priority Data

May 24, 2000 (JP) ..... 2000-153481

(51) Int. Cl.[7] ..... G03G 15/02
(52) U.S. Cl. ..... 399/175; 399/313
(58) Field of Search ..... 399/149, 150, 399/159, 161, 174, 175, 313, 318, 176, 66, 310; 430/45, 47, 126

(56) References Cited

U.S. PATENT DOCUMENTS 5,592,264 A * 1/1997 Shigeta et al. ..... 399/175
5,698,354 A * 12/1997 Ugai et al. ..... 430/45
5,970,285 A * 10/1999 Ito et al. ..... 399/149
6,167,229 A * 12/2000 Watanabe et al. ..... 399/313

FOREIGN PATENT DOCUMENTS

JP 5-127490 * 5/1993

* cited by examiner

*Primary Examiner*—Hoan Tran
(74) *Attorney, Agent, or Firm*—Fitzpatrick, Cella, Harper & Scinto

(57) ABSTRACT

An image forming apparatus includes an image bearing body, a surface of which includes a photosensitive body having a hardness in the range of 100 to 500 (N/mm$^2$), a charging device, which includes magnetic charging particles and is in friction contact with the image bearing body charges the image bearing body. A supporting member holds the magnetic charging particles with a magnetic force. An exposing device forms an electrostatic image by image exposing the image bearing body, which is charged by the charging means. A developing device develops the electrostatic image on the image bearing body. A transfer device transfers a developed image onto a transfer material and is in pressure contact with the image body. A pressure of the transfer material to the image bearing body is not less than 1 g/cm and not more than 100 g/cm in line pressure.

13 Claims, 21 Drawing Sheets

IMAGE FORMING APPARATUS CAPABLE OF PREVENTING DAMAGE TO A PHOTOSENSITIVE BODY BY CHARGING PARTICLES

BACKGROUND OF THE INVENTION

1. Field of the Invention

The present invention relates to an image forming apparatus employing an electrophotographic process or an electrostatic recording process such as a copying apparatus or a printer.

2. Related Background Art

In the image forming apparatus employing the electrophotographic process, the photosensitive member is generally charged by corona discharge.

In recent years, instead of such discharge method, there is being conceived an injection charging process practically involving no discharge.

In such injection charging process, it is required to achieve contact with the photosensitive member in a high density, but it is practically very difficult to maintain a roller or a blade in contact, without leaving a small gap, with the rotating photosensitive member.

It is therefore conceived to achieve injection charging by contacting a fine particle layer with the photosensitive member.

The Japanese Patent Application Laid-open No. 5-127490 proposes a charging apparatus of a magnetic brush type.

In the contact charging apparatus of magnetic brush type, conductive magnetic particles are held as a magnetic brush either directly on a magnet or on a sleeve incorporating a magnet, and the charging is initiated by contacting such magnetic brush in a stopped or rotating state with an image bearing body to be charged (hereinafter called photosensitive drum) and applying a voltage thereto. As the magnetic particles constituting the magnetic brush, the aforementioned Japanese Patent Application Laid-open No. 05-127490 describes that there are preferred magnetic particles with an average particle size not less than 30 $\mu$m and not more than 70 $\mu$m, free from protruding portions such as needle-shaped portions or edges, and made into a spherical shape in such a manner that the ratio of the longer axis and the shorter axis does not exceed 3 times.

However, in the image forming apparatus employing the contact charging apparatus of magnetic brush type as disclosed in the aforementioned Japanese Patent Application Laid-open No. 05-127490 as the charging means for the photosensitive drum and also employing the contact transfer charging process as the transfer means for a developer image from the photosensitive drum to a recording medium, there has been encountered a drawback of image defects such as image fog or ghost image, resulting presumably from defective charging.

Such situation occurs in case of paper-passing durability test utilizing, as the conductive magnetic particles for constituting the magnetic brush (hereinafter called carrier), "spherical carrier" particles formed by a polymerization process and having an average particle size of 50 $\mu$m, a saturation magnetization of 200 emu/cm$^3$ and a resistivity of $5\times10^6$ Ωcm.

However, satisfactory image formation, without the aforementioned image defects resulting from the defective charging, can be achieved with "crushed carrier" formed by a crushing process and having an average particle size of 25 $\mu$m, a saturation magnetization of 200 emu/cm$^3$ and a resistivity of $5\times10^6$ Ωcm instead of the spherical carrier.

This is presumably because the finely powdered carrier particles formed at the crushing operation increase the contact area between the photosensitive drum and the carrier thereby increasing the charging ability to the photosensitive drum.

However, if the crushed carrier is used, the carrier may leak for example by adhesion of the fine carrier particles to the photosensitive drum as described in the aforementioned Japanese Patent Application Laid-open No. 05-127490 and such leaking carrier may be subjected to the pressure of the contact transfer charging apparatus in the transfer portion to cause damage to the photosensitive drum, thereby significantly deteriorating the service life thereof.

Also, the image forming apparatuses have been made more compact in recent years, but such compactization of the entire image forming apparatus is inevitably limited by the compactization of the individual means or device of the image forming process steps such as charging, exposure, development, transfer, fixing and cleaning.

Also the toner remaining on the image bearing body after the image transfer (residual developer) is collected as waste toner by cleaning means (cleaner), but such waste toner is preferably absent in consideration of the environmental protection.

For this reason, there is already commercialized the image forming apparatus of a "cleanerless process" (cleanerless system, toner recycling system) in which the cleaner is dispensed with and the residual toner remaining on the image bearing body after the transfer step is removed from the image bearing body by "cleaning simultaneous with development" of the development means (developing device, developing unit) and is collected and reused in the development means.

In such cleaning simultaneous with development, the toner remaining in a certain amount on the image bearing body after the image transfer is collected, at the development in one of the subsequent process cycles, by a fog-eliminating bias (a fog-eliminating potential difference Vback between a DC voltage applied to the development means and the surface potential of the image bearing body).

In such process, since the residual toner after the development is collected in the development means and is used again in one of the subsequent process cycles, it is rendered possible to eliminate the waste toner and to reduce the amount of cumbersome maintenance work. Also, the absence of the cleaner provides a large advantage in space, thereby enabling significant compactization of the image forming apparatus.

However, the use of such cleanerless system in combination with the magnetic brush charging process results in drawbacks of a pass-through ghost and a hue variation in case of a color image.

FIG. 26 shows an example of image defect by a pass-through ghost. FIG. 26 shows an A4-sized sheet on which a character "A" is formed in a position (1) (real image or main image). The character "A" in the above-mentioned position (1) is not completely transferred but partially remains on the photosenstive drum as residual toner, which should be collected in the developing portion but is not completely collected and is transferred again onto the recording material to form an image in a position (2), called pass-through ghost, that should not be present ideally. This explanation of the phenomenon is also supported by a fact that the distance a shown in FIG. 26 coincides with the peripheral length of the photosensitive drum used.

It will be understood that the aforementioned pass-through ghost phenomenon breaks the basic concept of the cleanerless system and results in the destruction of the system itself. In the following there will be explained why the cleanerless system is broken by the pass-through ghost phenomenon.

The investigation of the present inventors has revealed that, in the cleanerless system, the collection of the transfer residual toner in the developing portion is limited and that the efficiency of collection and the mass of the transfer residual toner per unit area are mutually correlated.

More specifically, in a chart shown in FIG. 27, the ordinate indicates the level of the image defect (pass-through ghost) as shown in FIG. 26, evaluated in five levels, while the abscissa indicates the amount of the transfer residual toner per unit area. The amount of the transfer residual toner is adjusted by regulating the transfer current, thereby varying the transfer efficiency. In FIG. 27, marks ○ indicate the evaluated levels of the images in the position (1) in FIG. 26 while the marks x indicate the evaluated levels of the image in the position (2) (namely the levels of generation of the pass-through ghost images).

The marks x in FIG. 27 indicate that the pass-through ghost starts to be generated about where the amount of the transfer residual toner exceeds 0.06 mg/cm$^2$, and becomes more severe as the amount of the transfer residual toner increases.

However, the comparison of the marks x with the marks ○ evidently indicates that the level of the actual image remains quite acceptable even in the area where the pass-through ghost is generated. The level of the actual image becomes unacceptable only after the transfer efficiency is extremely lowered to a level where the amount of the transfer residual toner is equal to or larger than about 0.16 mg/cm$^2$, but has a considerably wider margin for the amount of the transfer residual toner, in comparison with the marks x.

As will be apparent from the foregoing description, the cleanerless system is made unacceptable by the presence of the pass-through ghost even in a situation where the formed actual image is quite acceptable.

Also in the color image forming apparatus of tandem or other type, there is encountered a drawback that a toner image once transferred onto the recording material or the intermediate transfer member is transferred again to the photosensitive drum (hereinafter called re-transfer) at the transfer of another toner image of a next color, whereby the desired toner image cannot be obtained.

In a color image forming apparatus employing the aforementioned cleaning system simultaneous with the development (for example an image forming apparatus formed by combining a color image forming apparatus of tandem system and a cleanerless process), a mixture of the transfer residual toner and the re-transferred toner is collected by the fog-eliminating bias Vback at the development. Since the re-transferred toner is different in color from the transfer residual toner, the collection of the re-transferred toner together with the transfer residual toner at the development results in mixing of colors in the developer. With the repetition of the image forming cycles, the toner of different color is accumulated in the developing apparatus, so that the desired color can no longer be obtained. Such phenomenon is particularly conspicuous when the amount of the re-transferred toner is large. In case the contact transfer charging method is employed in such image forming apparatus, there is encountered a drawback that the color hue immediately shows fluctuation because of the aforementioned reasons, whereby the cleanerless system is broken.

Such phenomenon will be explained in more detail in the following. As shown in FIGS. 28A and 28B, there were employed two image forming stations, which are respectively called a first state positioned at the upstream side in the conveying direction of the recording material and a second station positioned at the downstream side. In each of the first and second image forming stations, there is only illustrated a photosensitive drum and image forming process means therefor are omitted. In each of the first and second image forming stations, there was formed a stripe image (in the main scanning direction) representing an area of 6% for the A4 size.

In the second image forming station, the re-transferred toner generated in the course of image formation is collected, upon reaching the developing portion of the second image forming station, in the developing apparatus by the fog-eliminating bias.

For the purpose of quantitative evaluation, the re-transfer rate ηrtr is defined, as shown in FIGS. 28A and 28B by:

$$\eta rtr = b/(a+b) \times 100[\%]$$

wherein a [g/cm$^2$] is the toner amount per unit area of the recording material after the re-transfer, and b [g/cm$^2$] is the amount per unit area of the toner re-transferred onto the photosensitive drum.

Also the transfer efficiency ηrtr is similarly defined by:

$$\eta rtr = b'/(a'+b') \times 100[\%]$$

wherein a' [g/cm$^2$] is the toner amount per unit area of the recording material after the transfer, and b' [g/cm$^2$] is the amount per unit area of the transfer residual toner remaining on the photosensitive drum after the transfer.

This investigation employed yellow toner and magenta toner respectively in the first and second image forming stations and executed the formation of a magenta image (a stripe image in the main scanning direction representing 6% in A4 size), from an initial state (where yellow toner is completely absent in the magenta developing apparatus). The image formation was repeated in a similar manner for 10,000 sheets (intermittently by 100 sheets at a time), the color difference ΔE between the initial image and the image after each 1000 sheets was measured with X-RIteSP68. The transfer efficiency of the yellow toner in the first image forming station was always maintained at 95%.

The result of the investigation is shown in FIG. 29, in which the abscissa indicates the number of passed sheets while the ordinate indicates the change in the color difference. A curve A indicates the result obtained with a contact transfer charging apparatus (transfer roller) in the second image forming station, while a curve B indicates the result obtained with a non-contact transfer charging apparatus (corona charger) in the second image forming station as a comparative reference. These configurations respectively correspond to FIGS. 28A and 28B.

In FIG. 29, the curve A indicates that the color difference increases as the number of the passed sheets increases, and exceeds an upper limit value 6.5 of the color difference, giving a same color in impression when about 5000 sheets are passed. On the other hand, the curve B shows a smaller change in the color difference, apparently reflecting the difference in the transfer charging method.

SUMMARY OF THE INVENTION

An object of the present invention is to provide an image forming apparatus capable of charging by conductive particles.

Another object of the present invention is to provide an image forming apparatus employing a magnetic brush charging system and a cleanerless system.

Still another object of the present invention is to provide an image forming apparatus comprising: an image bearing body; charging means for charging the image bearing body, the charging means having a charging particle in friction contact with the image bearing body and thereby charging the image bearing body; electrostatic image forming means for forming an electrostatic image on the image bearing body charged by the charging means; developing means for developing the electrostatic image on the image bearing body; and transfer means and for transferring a developed image onto a transfer material at a pressure contact portion where the transfer means is in pressure contact with the image bearing body; wherein a pressure of the transfer material to the image bearing body is not less than 1 g/cm and not more than 100 g/cm in line pressure.

Still other objects of the present invention, and the features thereof, will become fully apparent from the following description which is to be taken in conjunction with the accompanying drawings.

DESCRIPTION OF THE PREFERRED EMBODIMENTS

Now the present invention will be clarified in detailed by preferred embodiments thereof, with reference to the accompanying drawings.

Figure 1:
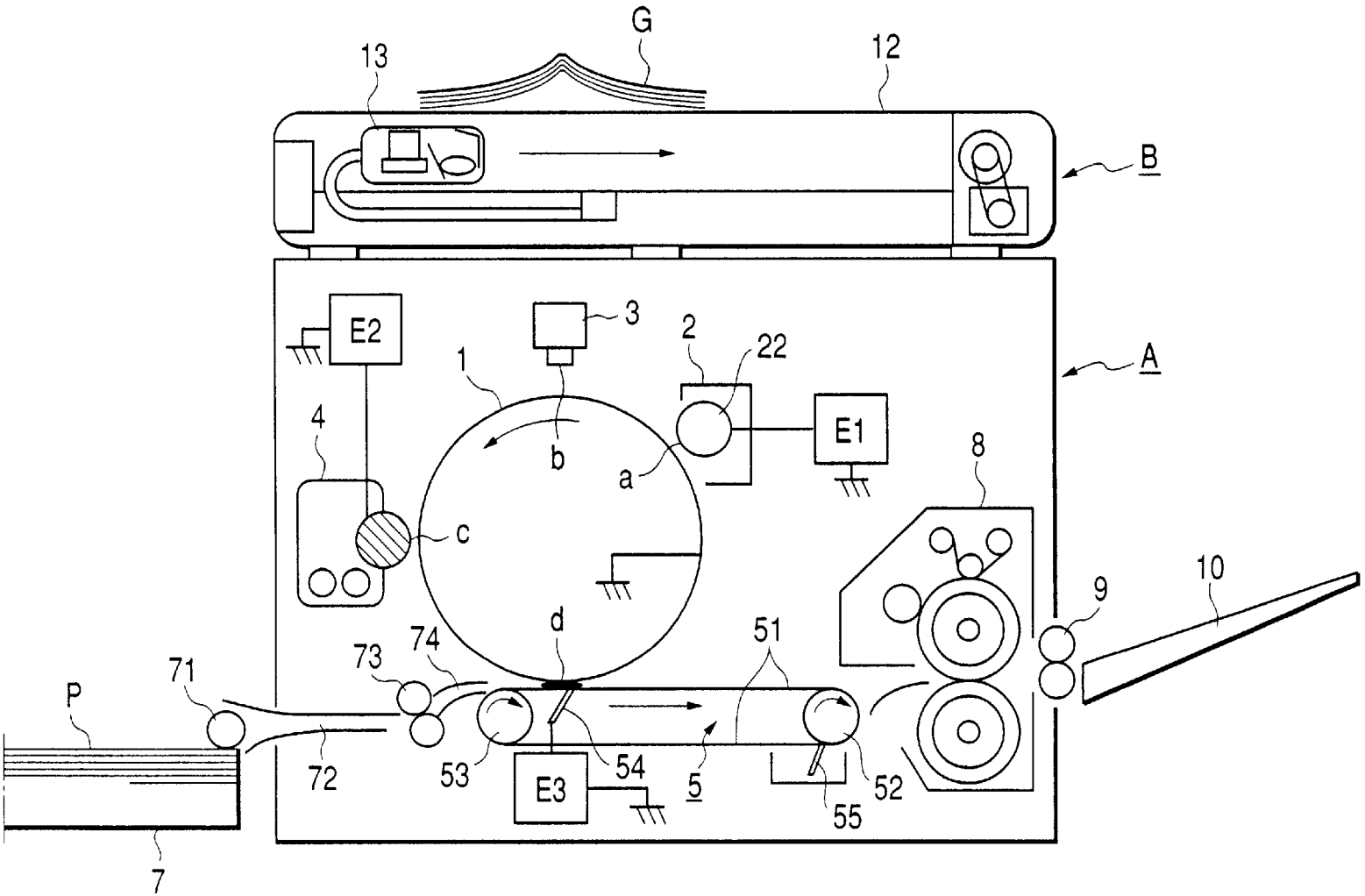
FIG. 1 is a schematic view showing the configuration of an image forming apparatus constituting a first embodiment.

FIG. 1 is a schematic view showing the configuration of an image forming apparatus embodying the present invention. The image forming apparatus of the present embodiment is a printer employing an electrophotographic process, a magnetic brush charging system, an LED exposure system, a reversal development system and a cleanerless system, wherein provided are a main body A of the printer and an image reading apparatus (image scanner) B mounted on the printer.

a) Image reading apparatus B

In the image reading apparatus B, there is provided an original supporting glass 12 fixed at the upper face of the apparatus, and an original G is placed, with the surface to be copied downward, on the original supporting glass 12 and is pressed thereon by an unrepresented original pressure plate.

An image reading unit 13 is provided with an original illuminating lamp, a short-focus lens array, a CCD sensor etc. In response to the depression of an unrepresented copy button, the image reading unit 13 is driven in a forward motion under the original supporting glass 12 from a solid-lined home position at the left-hand side of the glass to the right-hand side, and, upon reaching a predetermined end point of the forward motion, is reversed to the original solid-lined home position.

In the course of the forward motion of the unit 13, the downward image bearing surface of the original G placed on the original supporting glass 12 is illuminated in successive scanning motion by the original illuminating lamp of the unit 13 from the left-hand side toward the right-hand side, and the light reflected by the image-bearing surface of the original is focused by the short-focus lens array onto the CCD sensor.

The CCD sensor is composed of a light-receiving portion, a transfer portion and an output portion, and the light signal is converted in the light-receiving portion of the CCD into a charge signal, which is transferred in succession, in synchronization with clock pulses, in the transfer portion to the output portion. The output portion converts the charge signal into a voltage signal and outputs such voltage signal after amplification and conversion into a low impedance. An analog signal thus obtained is subjected to a known image processing to obtain a digital signal for supply to the printer A.

Thus the image reading apparatus B photoelectrically reads the image information of the original G as a time-sequential electric digital pixel signal (image signal).

b) Printer A

In the printer A, there is provided an electrophotographic photosensitive member 1 of a rotary drum shape (photosensitive drum) serving as an image bearing body. The photosensitive drum 1 of the present embodiment is provided with a negatively chargeable OPC photosensitive member having a charge injection layer on the surface thereof. This photosensitive member will be explained in more detail hereinafter in (2) Photosensitive drum 1.

The photosensitive drum 1 is rotated counterclockwise as indicated by arrow, about a central axis, with a predetermined peripheral speed, and, in response to the input of a copy signal, is subjected to a uniform charging process, to a potential of −700 V in the present embodiment, at a charging portion (charging area, charging nip portion) by contact charging means 2. In the present embodiment, the contact charging means 2 is composed of a magnetic brush charging apparatus (injection charging device). The charging apparatus 2 will be explained in more detail hereinafter in (3) Magnetic brush charging apparatus 3.

The uniformly charged surface of the rotary photosensitive drum 1 is subjected in an exposure position b, to scanning exposure of the image information by an LED exposure apparatus 3 serving as image exposure means, whereby an electrostatic latent image, corresponding to the image information of the original G photoelectrically read by the image reading apparatus B is formed in succession on the surface of the rotary photosensitive drum 1.

The LED exposure apparatus 3 is composed of a light-emitting element array in which a plurality of LED's are arranged along the main scanning direction of the photosensitive drum 1, and the light emission of each of the LED's of the LED exposure apparatus 3 is selectively turned on and off according to the image signal transferred from the image reading apparatus B to the printer A while the rotary photosensitive drum 1 is rotated to achieve sub scanning, whereby, on the surface of the rotary photosensitive drum 1, the potential is lowered to a light potential in a portion exposed to the light emitted by the LED to form a contrast to the potential in a non-exposed portion (dark potential) thereby forming an electrostatic latent image corresponding to the exposure pattern.

The electrostatic latent image formed on the surface of the photosensitive drum 1 is subjected, in a developing portion C of a developing apparatus 4, to reversal development, in the case of the present embodiment, thereby forming a toner image in successive manner. In the present embodiment, the developing apparatus 4 is composed of an apparatus of two-component contact development system. Such a developing apparatus 4 will be explained later in more detail hereinafter in (4) Developing apparatus 4.

On the other hand, a transfer material P contained as the recording medium in a sheet cassette 7 is advanced one by one by a feeding roller 71, then fed into the main body A of the printer through a sheet path 72, and conveyed by registration rollers 73 through a sheet path 74 at a predetermined control timing to a transfer portion (transfer nip portion) d which is a contact portion between the photosensitive drum 1 and a belt transfer apparatus 5 constituting transfer means.

On a surface of the transfer material P conveyed to the transfer portion d, the toner image on the surface of the photosensitive drum is electrostatically transferred in succession by a transfer charging blade (blade charger) 54 provided inside a transfer belt 51 and serving as a contact transfer charging member (contact transfer charger). Such a transfer 5 will be explained in more detail hereinafter in (5) Transfer apparatus 5.

The transfer material P passing through the transfer portion d and subjected to the transfer of the toner image is separated in succession from the surface of the photosensitive drum 1, then conveyed by an extended portion of the transfer belt of the transfer apparatus 5 to a fixing apparatus 8 and is subjected therein to heat fixation of the toner image, whereupon the transfer material P is discharged as an image product (copy or print) by discharge rollers 9 onto an outside discharge tray 10.

The transfer residual toner, remaining on the surface of the photosensitive drum 1 after the image transfer, is carried through the charging apparatus 2 to the developing portion c by the rotation of the photosensitive drum 1 and is collected into the developing apparatus 4 by the cleaning simultaneous with development (cleanerless process). This process will be explained in more detail hereinafter in (6) Cleanerless process.

(2) Photosensitive drum 1

The photosensitive drum 1 serving as the image bearing body can be composed of an ordinarily employed organic photosensitive member, but is preferably composed of an organic photosensitive member provided thereon with a surface layer of a resistivity of $10^9$ to $10^{14}$·Ωcm or an amorphous silicon photosensitive member to enable charging by charge injection, in order to achieve prevention of ozone generation or reduction of electric power consumption. It is also possible to improve the charging ability.

Figure 2:
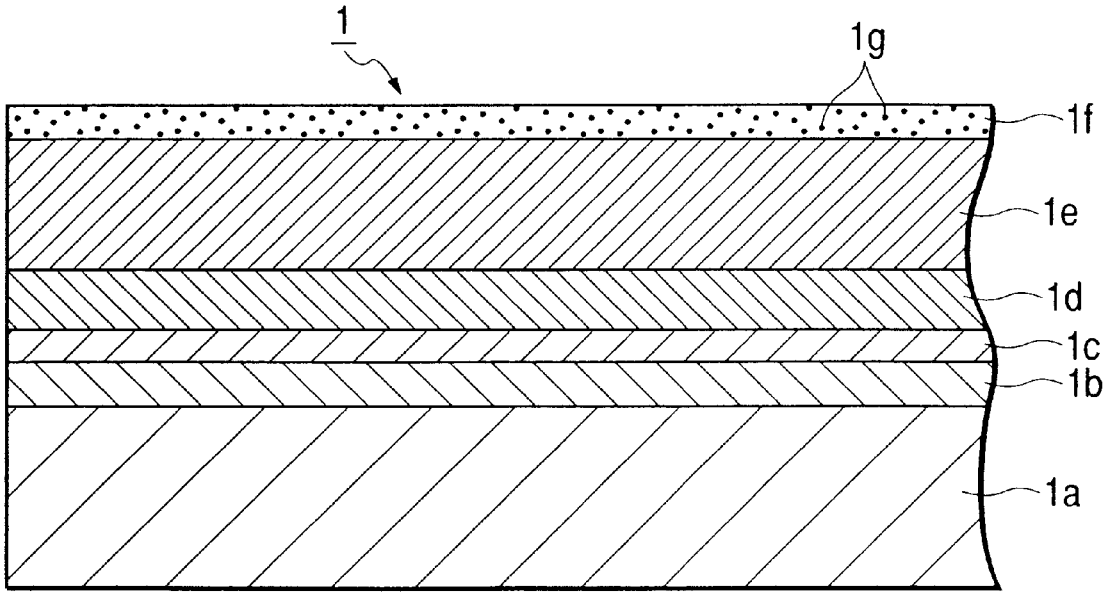
FIG. 2 is a schematic view showing the layer structure of a photosensitive drum.

The photosensitive drum 1 employed in the present embodiment is a negatively chargeable organic photosensitive member provided with a charge injection layer 1*f* on the surface as shown in FIG. 2 indicating the layered configuration, and is provided, on an aluminum drum substrate (hereinafter represented as aluminum substrate) 1*a* of a diameter of 30 mm, in succession with first to fifth layers 1*b* to 1*f* to be explained in the following:

first layer 1*b*: a subbing layer (undercoating layer) consisting of a conductive layer of a thickness of 20 μm provided for planarizing the surface defects of the aluminum substrate 1*a;* second layer 1*c*: a positive charge injection preventing layer for preventing that the positive charge injected from the aluminum substrate 1 cancels the negative charge present on the surface of the photosensitive member. It is a medium resistance layer of a thickness of 1 μm, of which resistance is adjusted to about $1\times10^6$·Ωcm with amilane resin and methoxymethylated nylon;

third layer 1*d*: a charge generating layer of a thickness of about 0.3 μm, composed of disazo dye dispersed in resin and adapted to generate positive and negative charges in pair, upon receiving light;

fourth layer 1*e*: a charge transport layer composed of P-type semiconductor formed by dispersing hydrazone in polycarbonate resin. The negative charge on the surface of the photosensitive member cannot move through this layer so that the positive charge alone generated in the charge generating layer 1*d* can be transported to the surface of the photosensitive member; and fifth layer 1*f*: a charge injection layer formed by coating a material in which ultrafine particles of $SnO_2$ as conductive particles 1 g are dispersed in an insulating binder resin. More specifically it is formed by coating a material formed by dispersing $SnO_2$ particles of a particle size of about 0.03 μm rendered conductive (low resistance) by doping antimony as light-transmitting insulating filler, in the resinous material by 70 wt %.

The charge injection layer is formed by coating thus prepared liquid by a suitable coating method such as dip coating, spray coating, roller coating or beam coating with a thickness of about 3 μm.

The hardness of the photosensitive drum was tested with a hardness tester Fischerscope H100 manufactured by Fischer Co., Germany. This test is capable of analyzing the hardness of a thin film, a hardened film, an organic film etc., and, in the preparation of the specimen for measuring the hardness of the photosensitive member, a surface layer of a thickness of about 10 μm was provided in order to avoid the influence of the underlying substrate. Therefore the substrate can for example be a glass plate, an Al plate or an Al cylinder and is not particularly limited. The conditions for hardening etc. were made identical with those at the preparation of the photosensitive member. The measurement was conducted by employing a diamond pressing probe in the shape of a square pyramid with an angle of 136° between the mutually opposed facets, pressing the probe into the film under stepwise predetermined loads and electrically detecting the press-in depth under the load, wherein the hardness H is represented by the ratio of the test load divided by the surface area of the trace generated under such test load. Also the universal hardness HU is represented by the hardness at the preset maximum press-in depth.

The hardness of the photosensitive member is preferably within a range of 100 to 500 $N/mm^2$. In the present embodiment, there was employed a photosensitive member with a hardness of 200 to 300 $N/mm^2$.

(3) Magnetic brush charging apparatus 2

Figure 3:
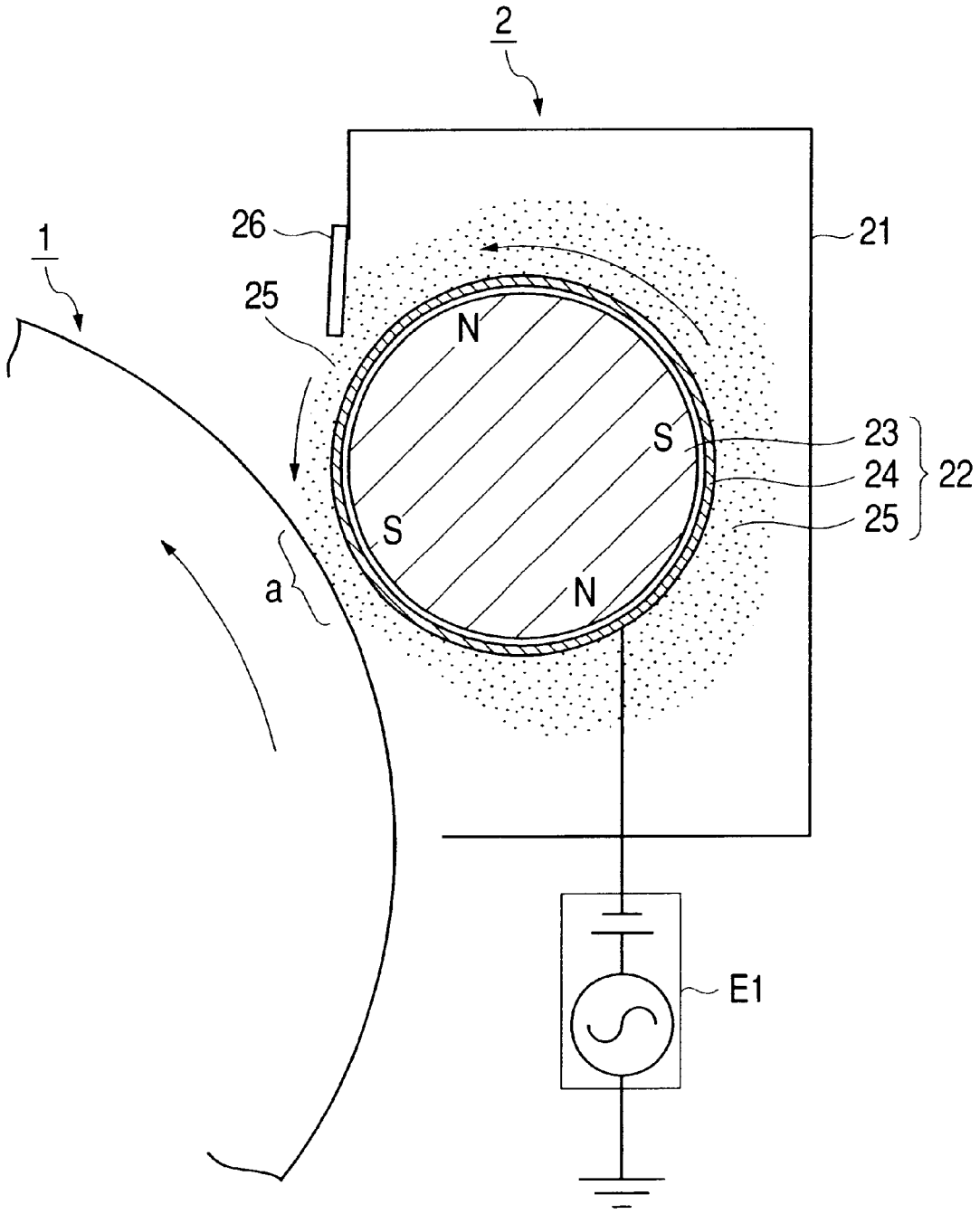
FIG. 3 is a magnified schematic view of a part including a magnetic brush charging apparatus.

FIG. 3 schematically shows the configuration of the magnetic brush charging apparatus 2 employed in the present embodiment.

There are shown a housing 21 of the charging apparatus, and a magnetic brush charging member (magnetic brush charger) 22 constituting a contact charging member provided in the housing. The magnetic brush charging member 22 of the present embodiment is of a rotary sleeve type and is composed of a magnet roll 23 fixedly supported in unrotatable manner, a non-magnetic sleeve (non-magnetic, conductive, charging electrode sleeve, hereinafter represented as injection sleeve) 24 of an outer diameter of 16 mm rotatably fitted on the external periphery of the magnet roll, and a magnetic brush 25 formed by conductive magnetic particles (magnetic charging carrier, hereinafter represented as injection carrier) attracted by and supported on the external periphery of the injection sleeve by the magnetic force of the magnet roll 23 positioned inside the sleeve. A thickness regulating blade 26 for the magnetic brush 25 is fixed on the housing 21.

The charging apparatus 2 is positioned substantially parallel with the photosensitive drum 1, in such a manner that the magnetic brush 25 of the magnetic brush charging member 22 is in contact with the photosensitive drum 1. The positioning is so adjusted that the contact nip width (width of the charging portion a) of the magnetic brush 25 formed with the photosensitive drum 1 becomes a predetermined value. In the present embodiment, the width of the nip formed with the photosensitive drum 1 is adjusted to be about 6 mm.

The injection carrier particles constituting the magnetic brush 25 preferably have an average particle size of 10 to 100 μm, a saturation magnetization of 20 to 250 kA/m ($emu/cm^3$) and a resistivity of $1\times10^2$ to $1\times10^{10}\cdot\Omega cm$. In consideration of the presence of defects in insulation such as pinholes on the photosensitive drum 1, the resistivity is preferably equal to or more than $1\times10^6\cdot\Omega cm$. Since the resistivity should be as small as possible in order to improve the charging ability, the present embodiment employed magnetic particles formed by crushing and granulating method and having an average particle size of 25 μm, a saturation magnetization of 200 kA/m and a resistivity of $5\times10^6\cdot\Omega cm$.

The resistivity of the injection carrier particles was measured by placing 2 g of the injection carrier particles in a metal cell with a bottom area of 228 $mm^2$ and applying a voltage of 100 V under a load of 6.6 kg.

The injection carrier can be, for example, resin carrier formed by dispersing magnetite as a magnetic material in a resinous material and also dispersing carbon black for giving conductivity and adjusting resistance, or carrier formed by oxidizing or reducing the surface of a single magnetite material such as ferrite for regulating the resisvitity, or carrier formed by coating the surface of a single magnetite material such as ferrite with a resinous material for regulating the resistance.

The injection sleeve 24 of the magnetic brush charging member was rotated, at the charging portion a, in a counterclockwise direction as indicated by an arrow, opposite to the rotating direction of the photosensitive drum 1. In the present embodiment, the injection sleeve 24 was rotated at a speed of 150 mm/sec while the photosensitive drum 1 was rotated at 100 mm/sec. Along with the rotation of the injection sleeve 24, the magnetic brush 25 composed of the injection carrier is rotated and carried in the same direction, and is subjected to a thickness regulation at the position of the thickness regulating blade 26, whereby the surface of the photosensitive drum 1 is uniformly rubbed by the magnetic brush 25 at the charging position a.

The injection sleeve 24 receives a predetermined charging bias from a bias source E1 whereby the photosensitive drum 1 is given a charge from the injection carrier of the magnetic brush 25 and is charged to a potential corresponding to the charging voltage. The uniformity of the charging is improved as the rotating speed becomes faster.

In the present embodiment, an oscillating voltage formed by superposing a DC voltage of −700 V and an AC voltage was applied as the charging bias.

In the present embodiment, since the photosensitive drum 1 is provided at the surface thereof with the charge injection layer 1*f* as explained in the foregoing, the charging of the photosensitive drum 1 is achieved by charge injection. Thus, there can be obtained, at the surface of the photosensitive drum, a charge potential substantially equal to the DC component (−700 V) within the DC+AC bias applied to the injection sleeve 24.

(4) Developing apparatus 4

Figure 4:
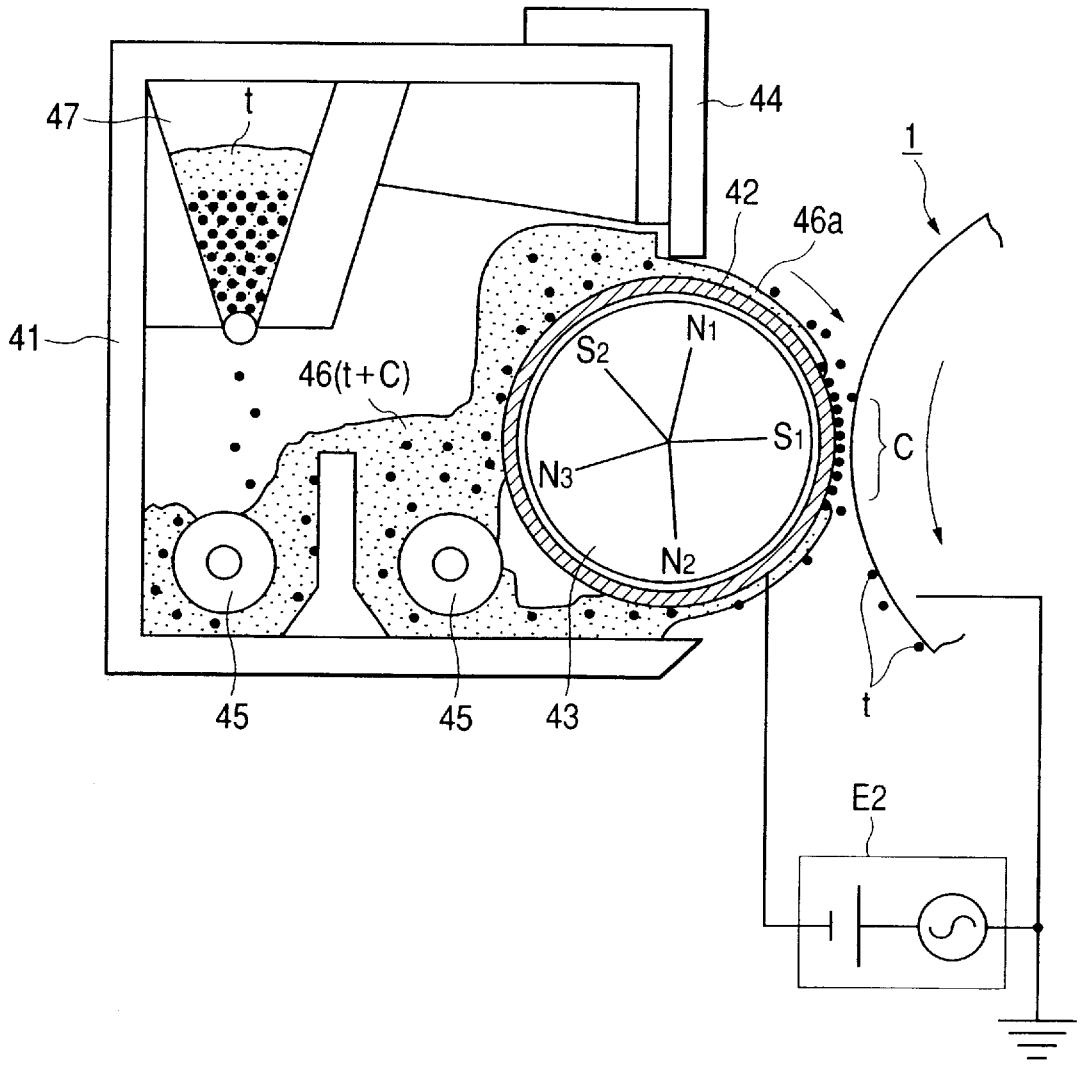
FIG. 4 is a magnified schematic view of a part including a developing apparatus.

FIG. 4 schematically shows the configuration of the developing apparatus 4 employed in the present embodiment. In the present embodiment, the developing apparatus 4 is of a two-component magnetic brush contact development system employing a mixture of non-magnetic negative toner particles and magnetic carrier particles as the developer, and causes a developer bearing member to hold such developer as a magnetic brush layer and to carry the developer to the developing portion c for contacting with the surface of the photosensitive drum 1 thereby executing reversal development of the electrostatic latent image into a toner image.

There are shown a developing container 41, a developing sleeve 42 serving as a developer bearing member, a magnet roller 43 fixed inside the developing sleeve 42 and serving as magnetic field generating means, a developer thickness regulating blade 44 for forming a thin layer of the developer on the surface of the developing sleeve, a screw 45 for agitating and carrying the developer, and a two-component developer 46 contained in the developing container 41 and composed of a mixture of non-magnetic negative toner particles t and magnetic carrier particles C.

In the two-component developer 46 employed in the present embodiment, the toner particles t were composed of negatively chargeable toner particles formed by a crushing method with an average particle size of 6 $\mu$m and externally added with titanium oxide of an average particle size of 20 nm in an amount of 1 wt. %, while the magnetic carrier particles C were composed of magnetic carrier particles of an average particle size of 25 $\mu$m and a saturation magnetization of 205 kA/m (emu/cm$^3$), and the toner t and the magnetic carrier were mixed in a weight ratio of 6:94.

The developing sleeve 42 is so positioned that the shortest distance (gap) to the photosensitive drum 1 is about 500 $\mu$m at least at the developing operation, whereby the thin layer 46*a* of the magnetic brush of the developer borne on the external periphery of the developing sleeve 42 comes into contact with the surface of the photosensitive drum 1. The contact portion between the developer magnetic brush layer 46*a* and the photosensitive drum 1 is the developing portion c.

The developing sleeve 42 is rotated counterclockwise, as indicated by an arrow, with a predetermined rotating speed outside the fixed magnet roller 43, and, in the developing container 41, the magnetic brush of the developer 46 is formed on the external periphery of the sleeve by the magnetic force of the magnet roller 44. The magnetic brush of the developer is carried together with the rotation of the sleeve 42, then regulated in thickness by the blade 44 and brought out from the developing container as a thin layer developer magnetic brush 46*a* of a predetermined thickness to the developing portion c. After contacting the photosensitive drum 1 therein, the magnetic brush is carried back again into the developing container 41 by the subsequent rotation of the sleeve 42.

More specifically, after being picked up by a magnetic pole $N_3$ of the magnet roller 43 in the course of rotation of the developing sleeve 42, the developer 46 is regulated by the regulating blade 44 perpendicular to the developing sleeve 42 in the course of carrying through the poles $S_2$ and $N_1$ whereby a thin layer 46*a* of the developer 46 is formed on the developing sleeve 42. When the thin layer 46*a* of the developer is carried to the main developing pole $S_1$ in the developing portion, a standing spike is formed by the magnetic force. The spike-formed developer layer 46*a* develops the electrostatic latent image of the photosensitive drum 1 into a toner image. Thereafter the developer on the developing sleeve 42 is returned by the repulsive magnetic field formed by the poles $N_2$, $N_3$ into the developing container 41.

Between the developing sleeve 42 and the conductive drum substrate of the photosensitive drum 1, there is applied, as the developing bias, an oscillating voltage by a developing bias source E2. In the present embodiment, the oscillating voltage was composed of a negative DC voltage of −500 V and an AC voltage with an amplitude Vpp=1500 V and a frequency Vf of 2000 Hz.

In the two-component developing process, the application of an AC voltage in general improves the developing efficiency thereby providing a higher image quality but also tends to generate a fog. For this reason, the fog is usually avoided by forming a potential difference between the DC voltage applied to the developing apparatus 4 and the surface potential of the photosensitive drum 1. Such potential difference for fog prevention is called a fog-eliminating voltage Vback, which prevents toner adhesion on the non-image area of the photosensitive drum 1 at the developing operation.

The toner concentration (mixing ratio with the carrier) of the developer 46 in the developing container 41 gradually decreases by the consumption of the toner in the development of the electrostatic latent image. The toner concentration of the developer 46 in the developing container 41 is detected by unrepresented detecting means, and, when it is lowered to a predetermined lower permissible limit, the toner t is replenished into the developer 46 in the developing container 41, whereby the toner concentration of the developer 46 in the developing container 41 is always maintained within a predetermined permissible range.

(5) Transfer apparatus 5

The transfer apparatus of the present embodiment is of transfer belt type as explained in the foregoing. An endless transfer belt 51 is supported between a drive roller 52 and an idler roller 53 and is rotated with a peripheral speed substantially same as that of the photosensitive drum, in a rotating direction same as that thereof. A transfer charging blade 54, provided inside the transfer belt 51 and serving as a contact transfer charging member, presses the upper portion of the transfer belt 51 toward the photosensitive drum 1 to form a transfer portion d, and receives a transfer bias from a transfer bias source E3 for providing a charge of a polarity opposite to that of the toner, from the rear surface of the transfer material P. Thus, onto the upper surface of the transfer material P passing through the transfer portion d, the toner image on the photosensitive drum 1 is electrostatically transferred in succession. The transfer material P is conveyed from the sheet conveying system to the transfer portion d formed by the photosensitive drum 1 and the transfer belt 51 at an appropriate timing synchronized with the rotation of the photosensitive drum 1. After the transfer step, the transfer belt 51 is cleaned by a cleaning member 55.

In the present embodiment, the transfer belt 51 was composed of polyimide resin of a thickness of 75 $\mu$m. The material of the transfer belt 51 is not limited to polyimide but can also be a plastic material such as polycarbonate, polyethylene terephthalate, polyfluorovinylidene, polyethylene naphthalate, polyetheretherketone, polyethersulfone or polyurethane, or a rubber material such as fluorinated or silicone rubber. Also the thickness is not limited to 75 $\mu$m but can be advantageous selected within a range of 25 to 2000 $\mu$m, preferably 50 to 150 $\mu$m.

The transfer charging blade 54 of the present embodiment will be explained with reference to FIG. 5. It is composed of a base member 54*a* of conductive rubber of a rectangular plate shape, and a conductive electrode 54*b* provided along the lower end portion of a surface of the base member 54*a*, is so positioned that the longitudinal direction of the base member 54*a* is substantially perpendicular (thrust direction) to the conveying direction of the recording material, and is pressed to the photosensitive drum 1 across the recording material or across the recording material and the transfer (conveying) belt 51, with a line pressure of 120 g/cm. The transfer pressure (line pressure) will be explained later in more detail in (7).

The base member 54*a* can be composed in general of a rubber material such as isoprene rubber, styrene rubber, butadiene rubber, nitrile rubber, ethylenepropylene rubber, butyl rubber, silicone rubber, chloroprene rubber, chlorosulfonated polyethylene, acrylic rubber, hydrine rubber, urethane rubber or fluorinated rubber, or synthetic rubber consisting of a composite of such rubber materials, or a synthetic resinous material such as nylon, polyurethane or polyester containing a conductivity providing agent such as tin oxide or carbon black, having a resistivity of $10^3$ to $10^{10}$·Ωcm and a hardness of 5 to 80° (JIS-A:JIS-K A-type tester). In the present embodiment, there was employed a transfer charging blade 54 of a resistivity of $10^5$ to $10^7$·Ωcm and a hardness of 50 to 70°, with a thickness of about 2 mm and a thrust length of 350 mm. The transfer charging blade is connected to the transfer high voltage source E3.

Figure 6:
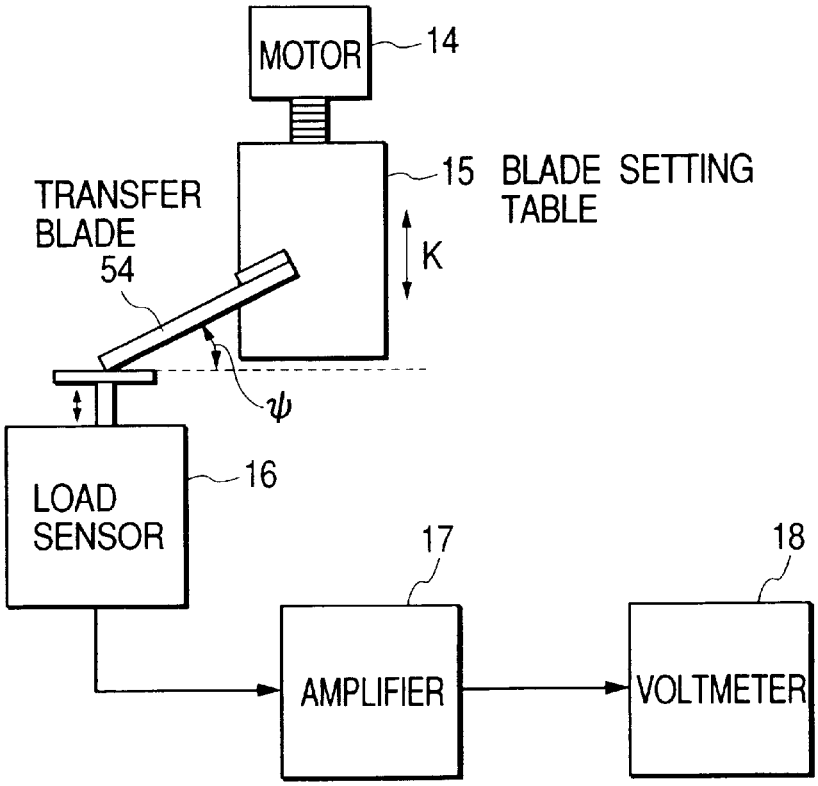
FIG. 6 is a view showing the method of measuring the transfer pressure (line pressure) of a transfer blade.

Now there will be explained the setting of the transfer pressure in the above-described transfer charging blade, with reference to FIG. 6. A blade setting member 15 is vertically movable, in a direction K, by a motor 14 and a screw rod. The transfer charging blade 54 is firmly clamped, at the base portion side (side of the conductive electrode 54*b*), to the blade setting member 15. Then the blade setting member 15 is lowered until the front end of the transfer charging blade 54 touches a load sensor 16, and further lowered against the elasticity of the transfer charging blade 54, whereby the load corresponding to the intrusion amount of the transfer charging blade 54 can be read as a voltage, by means of the load sensor 16, an amplifier 17 and a voltmeter 18. Then the line pressure per unit length can be obtained by dividing the voltage per unit voltage, determined in advance, with the length of the blade 54. In this is measured the relationship between the intrusion amount of the used transfer charging blade 54 and the line pressure per unit length (g/cm).

Then the transfer charging blade 54 is set on the main body of the image forming apparatus, with an intrusion amount corresponding to a desired transfer pressure (line pressure) in a state where the recording medium is present in the transfer portion.

(6) Cleanerless process

The transfer residual toner remaining on the photosensitive drum 1 after the transfer is carried through the charging apparatus 2 to the developing portion c by the subsequent rotation of the photosensitive drum 1, and is collected in the developing apparatus 4 by the cleaning simultaneous with development (cleanerless process).

The present embodiment employs a process in which the transfer residual toner, reaching the charging area a of the magnetic brush charging apparatus 2 by the rotation of the photosensitive drum 1, is fetched into the magnetic brush 25 of the magnetic brush charging member 22, thereby erasing the hysteresis of the preceding image and achieving more uniform charging. In this operation, the toner fetched into the magnetic brush 25 cannot be achieved sufficiently if a DC voltage alone is applied to the magnetic brush charging member 22, but can be relatively easily fetched by the application of an AC voltage to the magnetic brush charging member 22, owing to an oscillating effect of the electric field between the photosensitive drum and the magnetic brush charging member (charger)22.

However, such fetching into the magnetic brush 25 may become very difficult, depending on the charge amount of the transfer residual toner reaching the charging area a. Stated differently, as long as the transfer residual toner is charged, the fetching ability is significantly affected by the potential difference between the magnetic brush 25 and the photosensitive drum 1 and by the mirror reflection force between the toner and the photosensitive drum.

Ideally, the passing surface of the photosensitive drum 1 is charged to a potential equal to the voltage applied to the magnetic brush charging member 22, but the contact portion of the magnetic brush 25 has a certain width in practice, and there is inevitably generated a potential difference between the magnetic brush charging member 22 and the photosensitive drum 1 because sufficient charging cannot be achieved in an initial part in passing the contact portion, even if a substantially equal potential obtained eventually.

In the present embodiment, since the DC voltage Vdc applied to the magnetic brush charging member 22 is selected as −700 V, the positively charged toner tends to be fetched into the magnetic brush 25 in an area where the surface potential of the photosensitive drum is lower in the initial part in passing the contact area, but the negatively charged toner is not fetched. The transfer residual toner also remains on the photosensitive drum in case the charge amount of the residual toner is extremely large, resulting in a large mirror reflection force.

Consequently, the transfer residual toner is preferably charged positively even though it is negatively chargeable in its character. However, even if it is not charged positively, a forcedly scraping effect by the magnetic brush 25 can be expected if the absolute charge amount is sufficiently small.

Another concern is that, if the transfer residual toner fetched into the magnetic brush 25 remains positively charged, such toner is not discharged from the magnetic brush 25 but is accumulated therein because of the aforementioned relationship in the potential difference between the magnetic brush and the photosensitive drum. The toner present in excess of a certain amount in the magnetic brush deteriorates the charging ability even if the AC voltage is superposed, though such effect depends to a certain extent on the resistance of the toner.

Also, even if such toner mixed in the magnetic brush is discharged therefrom onto the photosensitive drum 1 for example by the rotary centrifugal force of the magnetic brush charging member 22, such toner is not collected, in the non-image area, by the developing apparatus 4 and remains on the photosensitive drum unless it is properly charged negatively.

Therefore, a cleanerless process stable over a long period can only be realized in a situation where the transfer residual toner, after fetching into the magnetic brush 25 of the magnetic brush charging member 22, is changed to properly negatively charged toner. Such situation can be realized by selecting the triboelectric charging series of the injection carrier constituting the magnetic brush 25 and the toner in such a manner that the toner is at a more negative side.

The present embodiment employs an injection carrier consisting of single magnetite particles such as of ferrite, coated surfacially with a resinous material for resistance adjustment, in combination with negative toner employing polyester as the binder resin.

Figure 7:
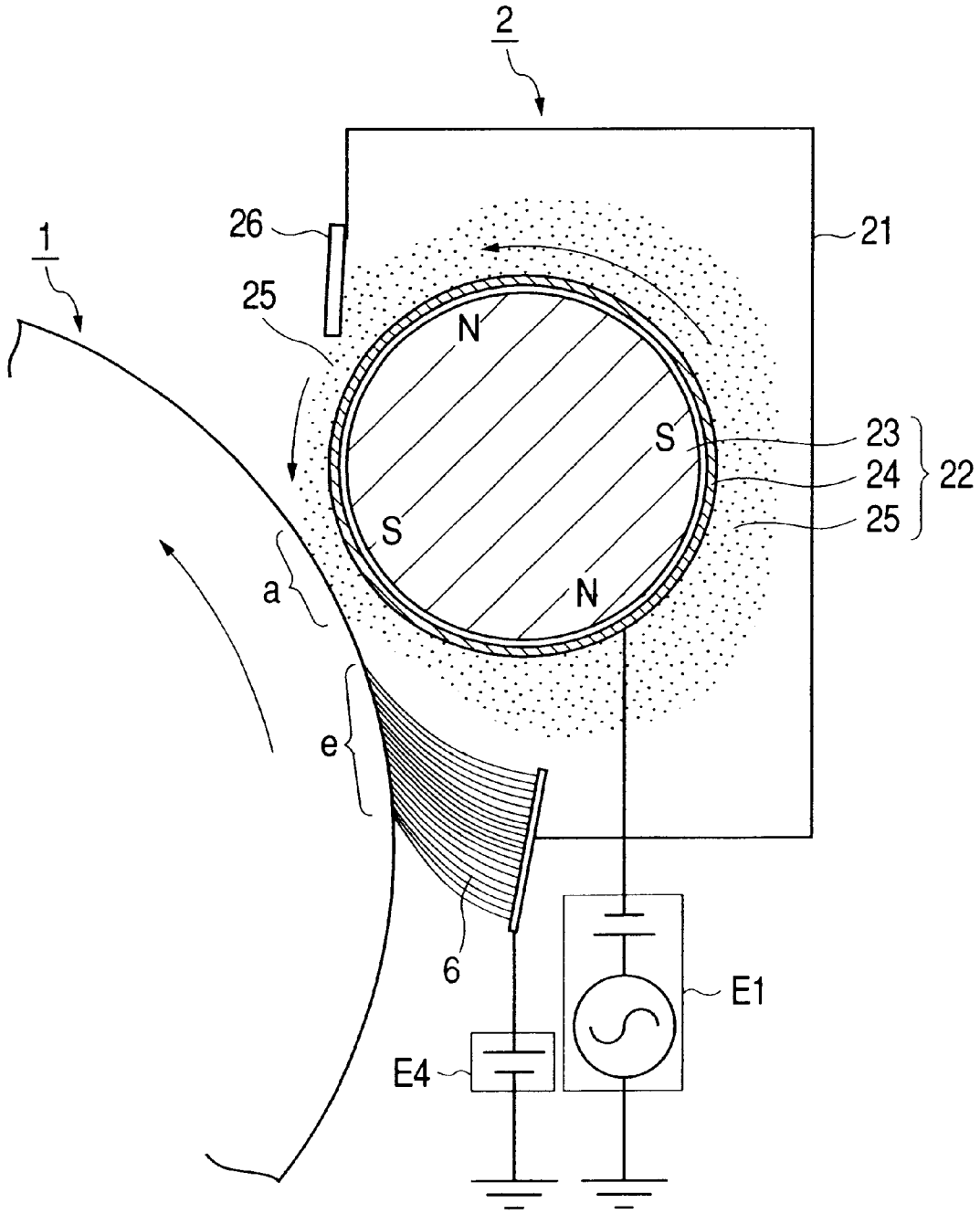
FIG. 7 is a magnified schematic view of a portion including a magnetic brush charging apparatus provided with an auxiliary electrode.

In order to achieve efficient fetching of the transfer residual toner, carried on the photosensitive drum 1 from the transfer portion d to the developing portion a, into the magnetic brush 25 on the magnetic brush charging member 22, it is also effective to provide a conductive brush 6 as auxiliary charging means in contact with the photosensitive drum 1, as shown in FIG. 7, in a position at the downstream side of the transfer portion d in the rotating direction of the photosensitive drum and at the upstream side of the charging portion a. "e" indicates the contact portion between the photosensitive drum 1 and the conductive brush 6. In the present embodiment, it is attached to the magnetic brush charging apparatus 2.

The transfer residual toner mixedly includes toner charged negatively according to the proper charging polarity, toner of which charging polarity is inverted to positive by the transfer bias or by the peeling discharge at the transfer, and toner of which negative charge is weakened or eliminated. Such transfer residual toner is agitated by the conductive brush 6 at the contact portion e thereof with the photoconductive drum 1, and, the toner charged negatively according to the proper charging polarity, the toner of which negative charge is weaked or eliminated and the toner which is inverted to positive but only charged weakly charged are fetched and mixed in the conductive brush by the electrical attractive force of the positive bias applied thereto. Then the charging polarity of such toners is inverted to positive by the friction with the conductive brush and by the positive bias applied from a bias source E4, and the toners thus positively charged are expelled, by the electrical repulsive force exerted by the bias applied to the conductive brush 6, from the conductive brush 6 and stick to the surface of the photosensitive drum 1.

Consequently, the charging polarity of the transfer residual toner is substantially aligned positive which is opposite to the original negative charging polarity by means of the conductive brush 6, and such toner is carried to the charging portion a by the subsequent rotation of the photosensitive drum 1.

The transfer residual toner carried by the photosensitive drum 1 to the charging portion a is fetched into the magnetic brush 25 of the magnetic brush charging member 22 and temporarily collected therein simultaneously with the charging. In this operation, as the transfer residual toner carried to the charging portion a is substantially alined to the positive charging polarity as explained in the foregoing, it is efficiently collected temporarily at the charging portion a from the surface of the photosensitive drum 1 to the negatively biased magnetic brush charging member 22 by the electrical attractive force thereof. In this operation, the fetching of the transfer residual toner into the magnetic brush 25 is further facilitated by applying an AC voltage to the magnetic brush charging member 22, owing to the oscillation effect of the electric field generated between the photosensitive drum 1 and the injection sleeve 24.

The transfer residual toner temporarily collected in the magnetic brush 25 is efficiently returned from the inverted positive charged state to the normal negative charging polarity, by the negative charging bias applied to the magnetic brush charging member 22 and by friction with the magnetic brush 25.

The transfer residual toner, temporarily collected in the magnetic brush 25 and efficiently return charged in the normal negative charged state, is expelled from the magnetic brush 25 by the electrical repulsive force of the negative charging bias applied to the magnetic brush charging member 22 and sticks to the surface of the photosensitive drum 1.

The transfer residual toner, charged in the normal negative charged state and expelled from the magnetic brush 25 onto the photosensitive drum 1, is carried by the subsequent rotation of the photosensitive drum 1 through the image exposure portion b of the image exposure apparatus 3 to the developing portion c of the developing apparatus 4 and is subjected to cleaning simultaneous with development (collection simultaneous with development) by the developing member of the developing apparatus 4.

(7) Consideration on the line pressure of contact transfer charging means on the image bearing body When the image formation was executed continuously with the above-described printer of the magnetic brush charging system and the contact transfer charging system shown in FIG. 1, there was generated an image defect consisting of a streak-shaped toner fog (hereinafter called streak fog) after about 5,000 image formations.

The cause of such streak fog, analyzed by the present inventors, will be explained in the following.

In the magnetic brush charging system (injection charging system), the photosensitive drum 1 is charged upon passing the charging nip a (charging portion or charging area) with the magnetic brush 25. If the charging is executed with the application of a DC voltage only, when the photosensitive drum starts to contact the charging nip a, the potential difference between the injection sleeve 24 and the photosensitive drum 1 is large so that the resistance of the injection carrier is low and the current flow easily. However, immediately before the photosensitive drum 1 is separated from the charging nip a, the surface of the photosensitive member already has a certain potential to reduce the potential difference between the injection sleeve 24 and the photosensitive drum 1, thereby elevating the resistance of the injection carrier. It is already known that the current therefore flows less to decrease the charging ability to the photosensitive drum 1. For this reason, in the magnetic brush charging system, there is often employed a method of applying an AC voltage simultaneous with the application of the DC voltage. Such AC voltage application reduces the resistance of the injection carrier, thereby stimulating the current and elevating the charging ability to the photosensitive drum 1, whereby the photosensitive drum 1 can be charged to the desired potential.

However, if the charging is executed with the simultaneous application of the AC voltage, a small potential difference is created between the photosensitive drum 1 and the injection sleeve 24 corresponding to the waveform of such AC bias. For example, in case fo charging to −500 V by DC voltage application and applying an AC voltage of 700 Vpp at the same time, potentials of −150 V and −850 V are locally present on the injection sleeve 24 and the photosensitive drum 1. While the photosensitive drum 1 passes through the charging nip a, the potential of the injection sleeve 24 is equal to that of the photosensitive drum 1, but, as soon as the photosensitive drum 1 has passed the charging nip a, the potentials show mutual aberration in phase between the injection sleeve 24 and the photosensitive drum 1. In case a phase difference such as −150 V on the injection sleeve 24 and −850 V on the photosensitive drum 1, there will result a potential different of 700 V therebetween. In such situation, between the injection sleeve 24 and the photosensitive drum 1, the voltage drop is largest between the injection carrier constituting the magnetic brush 25 and the photosensitive drum 1, so that the injection carrier is attracted to the photosensitive drum 1. Such phenomenon is called "carrier adhesion".

The carrier adhesion appears conspicuously by the application of the AC bias simultaneous with the DC bias application in order to increase the charging ability, but naturally appears also by the DC bias application only.

Also as the cleanerless system causes the fetching of the insulating transfer residual toner into the magnetic brush charging apparatus, namely into the magnetic brush 25 on the magnetic brush charging member 22, the aforementioned carrier adhesion is further enhanced by the lowering of the charging ability by such fetched toner.

It is also found that, when the injection carrier deposited by such carrier adhesion phenomenon reaches the transfer portion, the injection carrier enters between the transfer member and the photosensitive drum to cause a blemish thereon.

Such a small blemish of the photosensitive drum grows in the peripheral direction thereof by the contacting rotation of the magnetic brush 25, constituted by the injection carrier on the magnetic brush charging member 22.

It is further found that such damaged portion of the photosensitive drum tends to show a lower potential whereby the potential difference between the injection sleeve 24 of the magnetic brush charging member 22 and the photosensitive drum 1 is increased to accelerate the increase of the carrier adhesion.

Therefore, as the sheet passing test is repeated, the blemish in the peripheral direction of the photosensitive drum and the carrier adhesion further increase to form a deeper blemish, and the position of such blemish is unable to obtain the desired potential and is developed into a streak. Such phenomenon is identified as the cause of the aforementioned streak fog.

Also in case of changing the shape of the injection carrier from spherical shape to crushed shape in order to increase the charging ability, such crushed carrier particles have many edges and are more often in point contact with the photosensitive drum, thus resulting in an increased pressure in such contact position. It is thus found that the photosensitive drum is more easily damaged when the crushed carrier is employed.

In any case, the occurrence of such image defect significantly reduces the service life of the photosensitive drum, thus leading to the destruction of the cleanerless system.

In addition, in the crushed carrier, the edges present in a large number and showing a very large pressure in contact with the photosensitive drum are a cause of accelerating the blemish formation on the photosensitive drum, and, within the preferred range of hardness of the photosensitive member, the possibility of blemish formation is quite high.

In order to avoid the generation of the aforementioned image defect, it is conceivable to reduce the contact pressure at the transfer to zero, for example by employing a corona charger for the transfer charger, but the non-contact corona charging is undesirable environmentally because of very large ozone generation.

Figure 8:
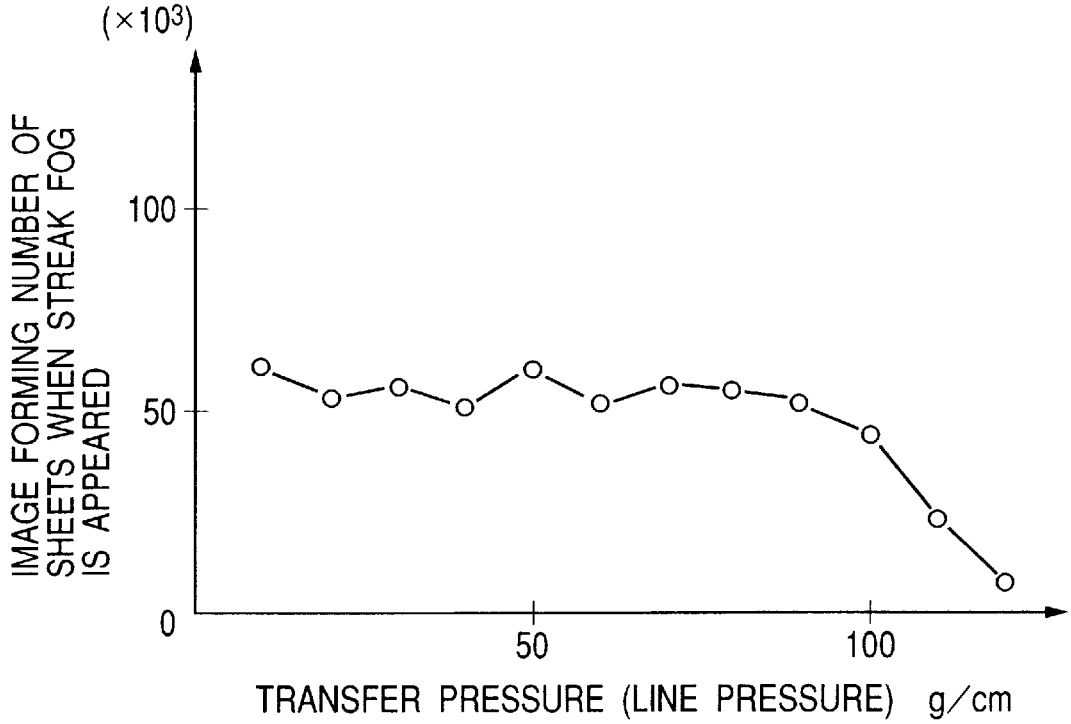
FIG. 8 is a chart showing the relationship between the transfer pressure and the number of image formations when streak fog is generated.

Therefore the present inventors have investigated the number of image formations until the generation of the streak fog at an image ratio of 5%, taking, as a parameter, the pressure of the contact transfer charging apparatus to the photosensitive drum (namely transfer pressure which is the pressure of the contact transfer charging apparatus on the image bearing body in a state where the recording medium is present in the transfer portion). The obtained results are shown in FIG. 8. The results shown in FIG. 8 indicate that, in the contact transfer charging apparatus with the transfer pressure (line pressure) defined by the aforementioned method, the streak fog occurs at about 5000 sheets under a transfer pressure of 120 g/cm but only at about 50000 sheets under a transfer pressure of 80 g/cm, suggesting the significance of the transfer pressure. However the streak fog becomes less when the transfer pressure is reduced to about 100 g/cm, and even less at the transfer pressure of 80 g/cm. In a range of the transfer pressure equal to or less than 80 g/cm, the number of image formations causing the streak fog does not change too much, and the streak fog in such range presumably has a different cause, possibly by gradual abrasion of the photosensitive drum 1 by the frictional contact with the magnetic brush 25.

Figure 9:
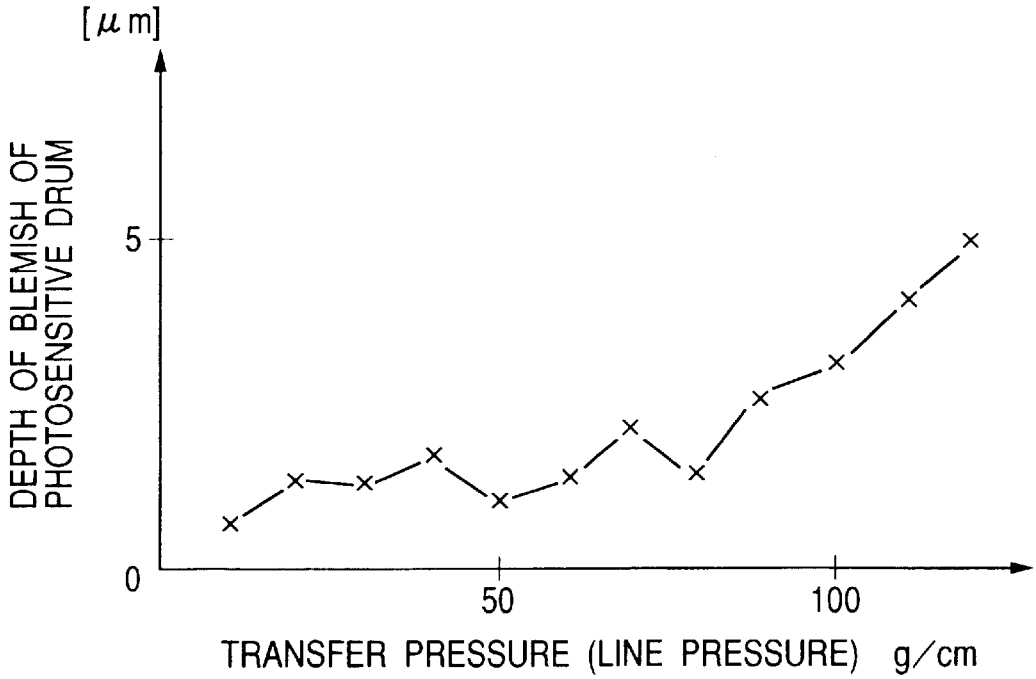
FIG. 9 is a chart showing the relationship between the transfer pressure and the depth of blemish of the photosensitive drum.

The foregoing analysis is also supported by the data showen in FIG. 9, which shows the depth of blemishes shown in FIG. 9, which shows the depth of blemishes formed after 20000 image formations on the photosensitive drum and causing the aforementioned streak fog, as a function of the transfer pressure. The measurement was conducted with the surface coarseness tester SE-3300 manufactured by Kosaka Laboratory Co., Ltd. At a transfer pressure of 110 g/cm or higher, the depth of the blemish already exceeds 4 $\mu$m at 20000 image formation, indicating that the portion of such blemishes no longer functions as the photosensitive drum. On the other hand, at a transfer pressure not exceeding 80 g/cm, the blemishes are not deep but remain at 1 to 2 $\mu$m presumably because of the above-described reason.

These results indicate that, in the image forming apparatus of the present embodiment, the photosensitive drum can be prevented from formation of shape blemish and can achieve stable image formation over a prolonged period if the pressure of the contact transfer charging apparatus toward the photosensitive drum is maintained not exceeding 100 g/cm, preferably not exceeding 80 g/cm, in a state where the recording medium is present in the transfer portion.

On the other hand, a line pressure of 1 g/cm at minimum is required for the transfer pressure, since, at a transfer pressure of 0 g/cm, there was observed transfer skipping, presumably caused by the unstable or non-uniform transfer pressure.

Also in case a transfer blade and a transfer roller were employed as the contact transfer charging members, there was observed a phenomenon of fusion of the injection carrier onto the surface of the photosensitive drum in the use of the transfer roller. Though the mechanism of this phenomenon is still under investigation, the present embodiment employed the transfer blade 54 since the transfer blade is more advantageous against the fusion phenomenon.

In the present embodiment, there has been explained the magnetic brush injection charging system for effecting charging by contacting conductive magnetic particles, under a voltage application, with the image bearing body provided with the surfacial charge injection layer, but the configuration similar to the present embodiment can avoid formation of the sharp blemishes on the photosensitive member in the magnetic brush charging apparatus other than the injection charging system.

Also the foregoing has explained a case of direct image transfer from the photosensitive drum to the recording material, but the effects of the present invention can likewise be expected in the primary transfer of an image forming apparatus employing an intermediate transfer member.

(second embodiment)

Figure 10:
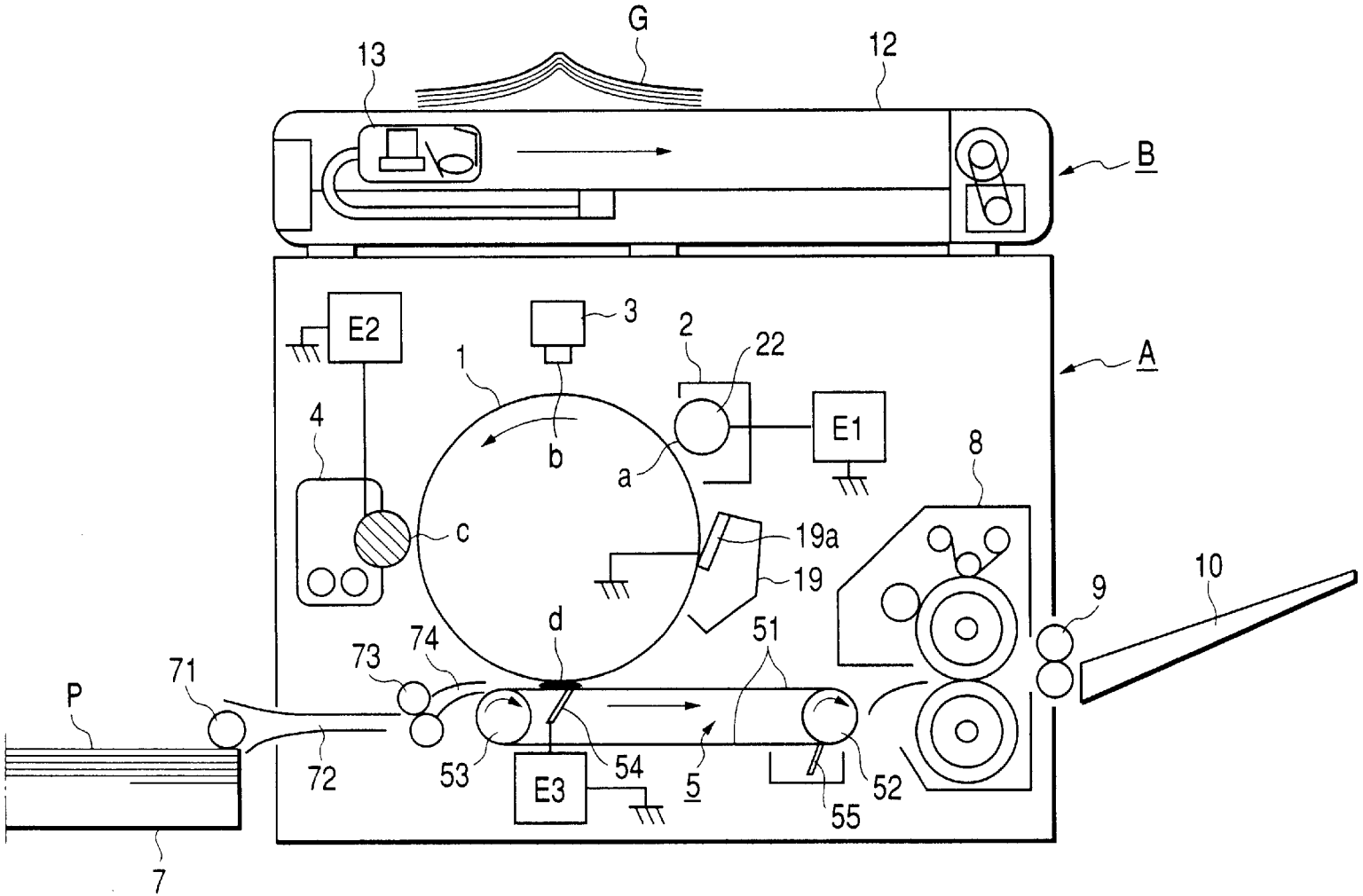
FIG. 10 is a schematic view showing the configuration of an image forming apparatus constituting a second embodiment.

The printer of the present embodiment shown in FIG. 10 is provided, in the aforementioned printer of the first embodiment (FIG. 1) with a cleaning apparatus (cleaner) 19 positioned between the transfer portion d and the charging portion a, for cleaning the surface of the photosensitive drum 1 after the transfer by eliminating the transfer residual developer, paper dust etc.

Other configurations of the printer are the same as those of the printer of the first embodiment and will not, therefore, be explained further.

The cleaning apparatus 19 in the present embodiment employs a cleaning blade 19*a* for cleaning the photosensitive drum 1. The cleaning blade 19*a*, which is an elastic blade of urethane rubber, is pressed to the photosensitive drum 1 to eliminate a large portion of the transfer residual developer and the paper dusts remaining on the photosensitive drum 1 after the transfer.

Consequently, in comparison with the cleanerless printer, the carrying, mixing and adhesion of the transfer residual developer and the paper dusts to the charging portion a are significantly reduced, whereby there are obtained more satisfactory charging ability and stable image quality. At the same time, there is significantly reduced the carrier adhesion resulting from the deterioration of the charging ability, caused by the toner mixing in the charging portion a.

In an investigation on the present configuration, similar to that in the first embodiment (FIG. 8), the streak fog was generated at 50000 image formations under a transfer blade pressure (transfer pressure) of 120 g/cm. The reduced carrier adhesion decreases the cause of blemish formation on the photosensitive drum, thereby enabling image transfer at a line pressure higher than in the configuration of the first embodiment.

(third embodiment)

Figure 11:
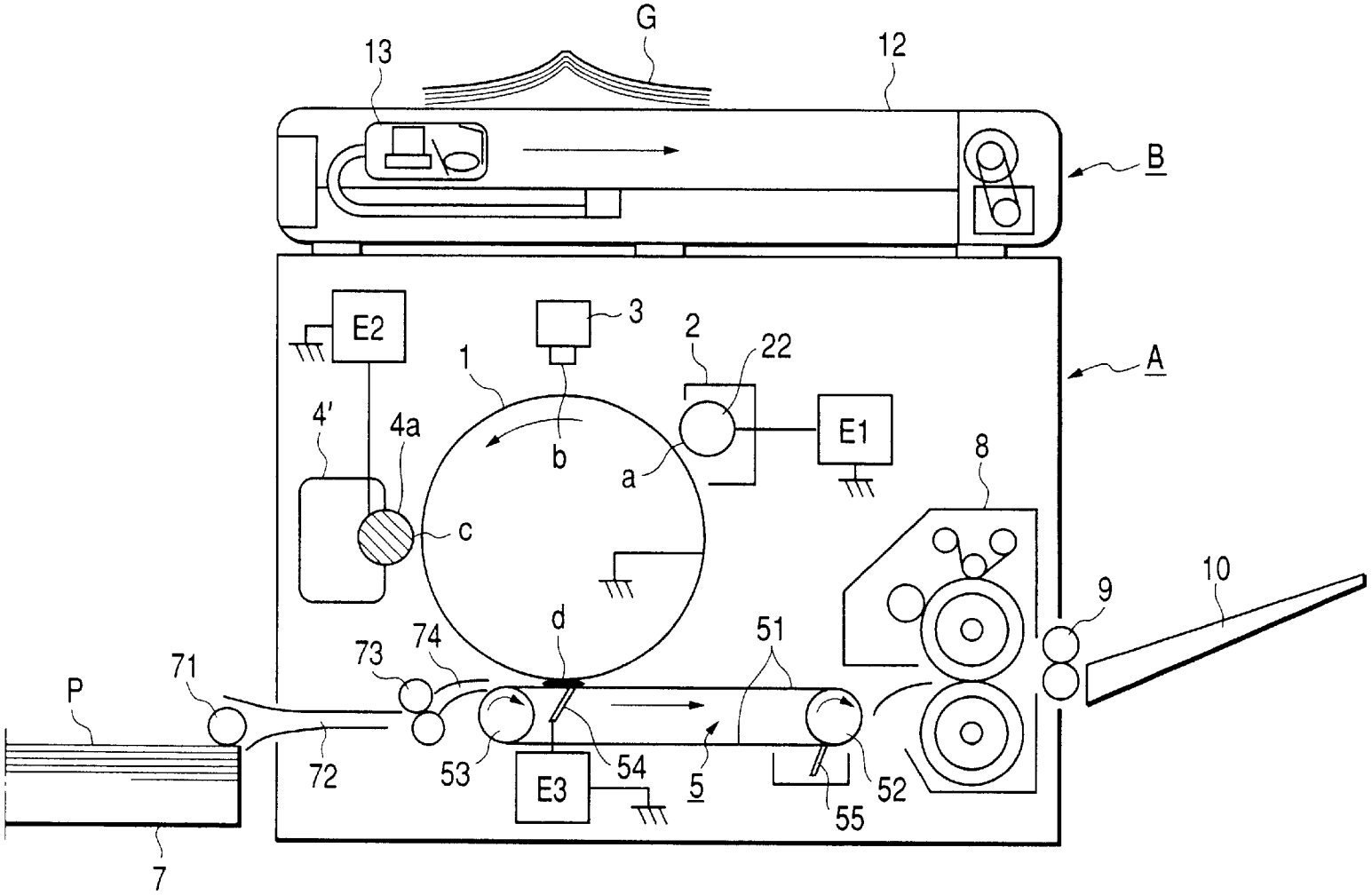
FIG. 11 is a schematic view showing the configuration of an image forming apparatus constituting a third embodiment.

FIG. 11 shows an image forming apparatus of the present embodiment, in which, in the printer of the first embodiment (FIG. 1), the developing apparatus 4 of the two-component magnetic brush contact development system is replaced by a one-component non-contact developing apparatus 4'. Other configurations of the apparatus are same as those in the first embodiment and will not, therefore, be explained further.

In the following there will be explained the one-component non-contact developing apparatus 4' employed in the present embodiment. A non-magnetic developing sleeve 4*a* of a diameter of 16 mm, incorporating a magnet, is coated with the aforementioned toner and is rotated at a same speed as that of the photosensitive drum 1 with a fixed distance of 300 $\mu$m thereto, and is given a developing bias voltage from a developing bias source E2. The bias voltage is composed of a DC voltage of −500 V superposed with a rectangular AC voltage of a frequency of 1800 Hz and a peak-to-peak voltage of 1600 V, and the jumping voltage is executed between the sleeve 4*a* and the photosensitive drum 1.

The developing apparatus 4' of the present embodiment, being non-contact type, scarcely has the direct scraping effect on the deposited injection carrier, in comparison with the developing apparatus of contact type. According to the investigation of the present inventors, the streak fog under a transfer pressure (line pressure) of 80 g/cm was at 50000 image formations, and, in the configuration of the present embodiment, the photosensitive drum may be more easily damaged in comparison with the first embodiment. However, as in the first embodiment, a transfer pressure not exceeding 80 g/cm allowed to prevent formation of sharp blemishes on the photosensitive drum and to achieve stable image formation over a prolonged period.

(fourth embodiment)

Figure 12:
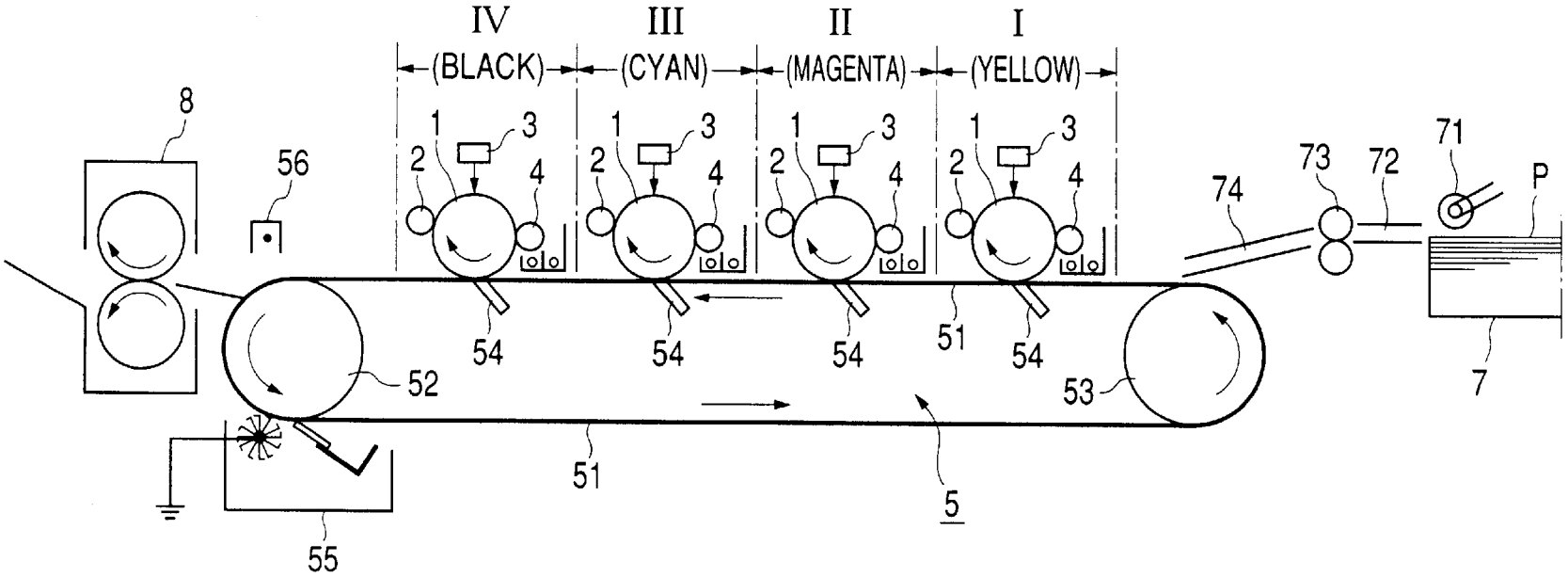
FIG. 12 is a schematic view showing the configuration of an image forming apparatus constituting a fourth embodiment.

FIG. 12 shows an image forming apparatus of the present embodiment, consisting of a four-color tandem color printer in which four image forming portions arranged in succession independently execute image forming processes and the toner image formed in such image forming portions are superposed in succession and in one path on the recording material to synthesize a full-color toner image.

There are shown first to fourth image forming portions I, II, III, IV which are arranged in tandem from right to left, and which, in the present embodiment, are respectively a yellow image forming portion, a magenta image forming portion, a cyan image forming portion and black image forming portion.

Each of the first to fourth image forming portions I, II, III, IV is an electrophotographic image forming mechanism of magnetic brush charging system, reversal development system and cleanerless system as in the printer of the first embodiment (FIG. 1), and is provided with an electrophotographic photosensitive drum 1 serving as an image bearing body, a magnetic brush charging apparatus 2, an LED exposure apparatus 3 serving as an image information writing apparatus, and a developing apparatus 4.

The developing apparatus 4 of the first image forming portion I utilizes yellow toner as the developer; that 4 of the second image forming portion II utilizes magenta toner; that 4 of the third image forming portion III utilizes cyan toner; and that 4 of the fourth image forming portion IV utilizes black toner.

A transfer apparatus 5 consists of a transfer belt apparatus provided substantially horizontally under the first to fourth image forming portions I, II, III, IV and is similar to the transfer belt apparatus 5 in the printer of the first embodiment. However, in the transfer portions of the image forming portions I, II, III, IV, there are provided four transfer charging blades 54 for pressing the upper portion of a transfer belt 61 to the lower portions of the photosensitive drums 1 of the image forming portions I, II, III, IV for respectively forming transfer portions (transfer nip portions).

The image forming operation is same in the image forming portions I, II, III, IV.

However, the photosensitive drum 1 of the first image forming portion I is subjected to imagewise exposure corresponding to a yellow component image of a full-color image, thereby forming a corresponding electrostatic latent image. The photosensitive drum 1 of the second image forming portion II is subjected to imagewise exposure corresponding to a magenta component image of the a full-color image, thereby forming a corresponding electrostatic latent image. The photosensitive drum 1 of the third image forming portion III is subjected to imagewise exposure corresponding to a cyan component image of the full-color image, thereby forming a corresponding electrostatic latent image. The photosensitive drum 1 of the fourth image forming portion IV is subjected to imagewise exposure corresponding to a black component image of the full-color image, thereby forming a corresponding electrostatic latent image.

The electrostatic latent image on the photosensitive drum 1 of the first image forming portion I is reversal developed by the developing apparatus 4 as a yellow toner image. The electrostatic latent image on the photosensitive drum 1 of the second image forming portion II is reversal developed by the developing apparatus 4 as a magenta toner image. The electrostatic latent image on the photosensitive drum 1 of the third image forming portion III is reversal developed by the developing apparatus 4 as a cyan toner image. The electrostatic latent image on the photosensitive drum 1 of the fourth image forming portion IV is reversal developed by the developing apparatus 4 as a black toner image.

On the other hand, a transfer material P serving as the recording material stacked in a sheet cassette 7 is advanced and fed one by one by a feeding roller 71, and fed through a sheet path 72, registration rollers 73 and a sheet path 74 onto the upper part of the transfer belt 51 of the transfer belt apparatus 5 at a predetermined control timing. Each of the transfer charging blades 54 receives a predetermined transfer bias at a predetermined control timing from an unrepresented transfer bias source.

The transfer material P fed onto the transfer belt 51 is electrostatically attracted thereon and is conveyed in succession through the transfer portions of the first to fourth image forming portions I, II, III, IV along with the rotation of the transfer belt 51, thereby being subjected to four superposed transfers of toner images, namely the transfer of the yellow toner image of the photosensitive drum 1 of the first image forming portion I in the first transfer portion, the transfer of the magenta toner image of the photosensitive drum 1 of the second image forming portion II in the second transfer portion, the transfer of the cyan toner image of the photosensitive drum 1 of the third image forming portion III in the third transfer portion, and the transfer of the black toner image of the photosensitive drum 1 of the fourth image forming portion IV in the fourth transfer portion, The transfer charging blades 54 execute charging of a polarity opposite to that of the toners, from the back side of the transfer material P. Thus, on the surface of the transfer material P passing through the transfer portions in succession, the toner images of the photosensitive drums 1 are electrostatically transferred in succession. In this manner there is synthesized a desired full-color toner image on the surface of the transfer material.

The toner images are formed in the image forming portions I to IV in predetermined timings, and the toner images of the image forming portions I to IV are transferred onto the same transfer material P conveyed by the transfer belt apparatus 5 in such a manner that they are mutually superposed with predetermined mutual alignment.

The transfer material P conveyed by the transfer belt 51 and having passed the last fourth transfer portion is separated from the transfer belt 61 and is introduced into a heat fixing apparatus 8 wherein the unfixed full-color toner image on the transfer material is fixed by heat and pressure as a permanently fixed image. A charge eliminator 56 is provided for separating the transfer material.

Also in the color printer of the present embodiment, the transfer pressure (line pressure) of the transfer portions of the first to fourth image forming portions I to IV is selected as in the foregoing first to third embodiments, whereby stable and satisfactory image formation can be achieved in continuous manner without damaging the photosensitive drum by the crushed carrier in the prolonged durability test.

The following fifth to seventh embodiments are to attain the aforementioned second object, namely to resolve the drawbacks of pass-through ghost in the image forming apparatus employing the cleanerless process and the contact transfer charging system and color hue fluctuation in the color image forming apparatus.

(fifth embodiment)

(1) Schematic configuration of image forming apparatus

Figure 13:
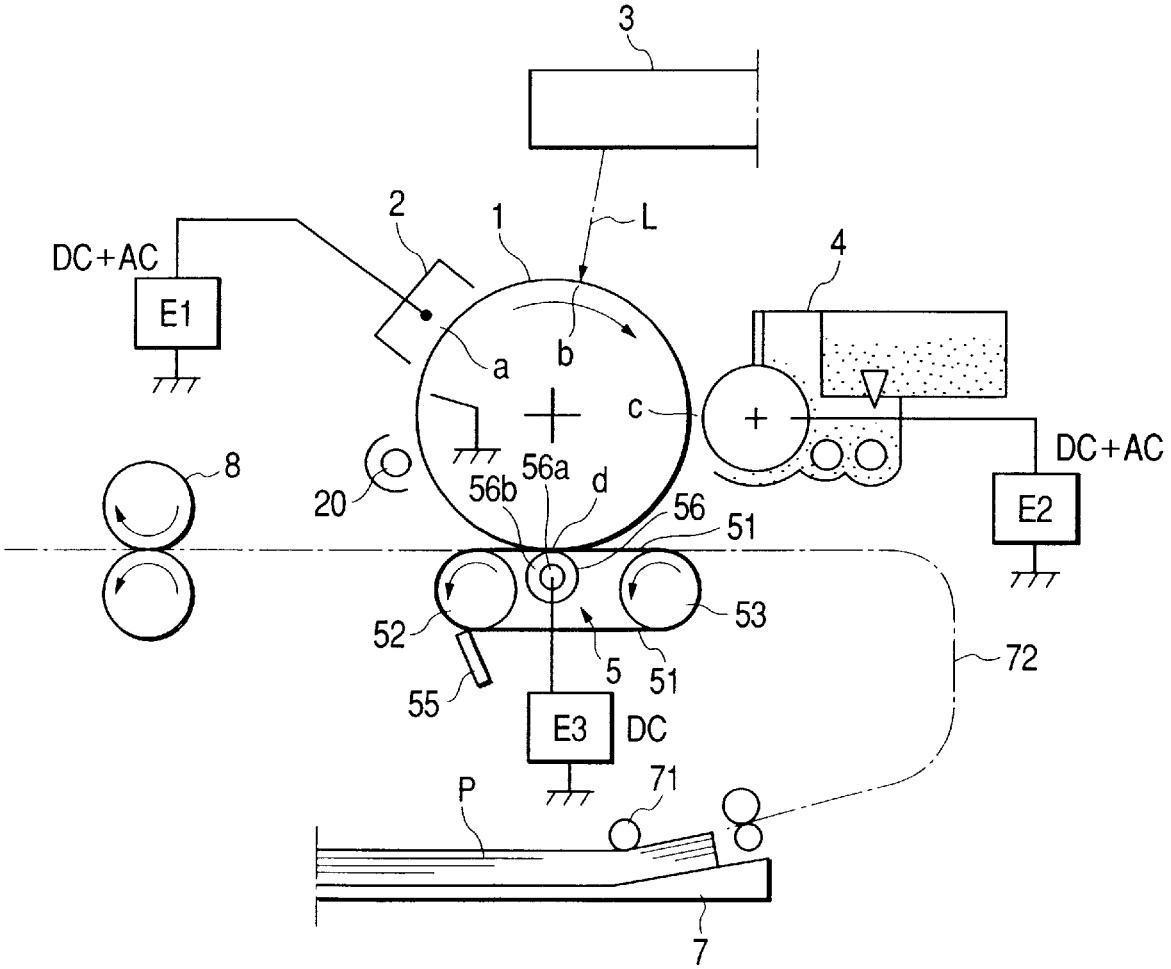
FIG. 13 is a schematic view showing the configuration of an image forming apparatus constituting a fifth embodiment.

FIG. 13 shows an image forming apparatus of the present embodiment, which is a laser beam printer employing the electrophotographic process of transfer type, the cleanerless process and the contact transfer charging system.

There is provided an electrophotographic photosensitive member 1 of rotary drum shape (photosensitive drum) serving as an image bearing body. The photosensitive drum 1 of the present embodiment is a negatively chargeable OPC (organic photoconductor) photosensitive and is rotated clockwise as indicated by an arrow, with a process speed (peripheral speed) of 150 mm/sec. The photosensitive member is not limited to the OPC photosensitive member explained above but can be composed of other types such as an amorphous silicon photosensitive member.

A charging apparatus 2 is provided for uniformly charging the surface of the photosensitive drum 1 to predetermined polarity and potential. In the present embodiment, it is composed of a corona charging apparatus which uniformly charges the surface of the rotating photosensitive drum 1 at about −700 V. Also the charging means is not limited to the corona charging apparatus employed in the present embodiment but can also be composed for example of conductive fibers formed into a brush (fur brush charging member or charging fur brush), a blade composed of conductive rubber (charging blade), a roller composed of conductive rubber (charging roller), or a magnetic brush charging member in which magnetic particles are magnetically supported on a bearing member to constitute a magnetic brush (magnetic charging brush or magnetic brush charger).

Image information exposure means (image exposure apparatus) 3 is composed, in the present embodiment, of a laser beam scanner. The laser beam scanner 3 is provided with a semiconductor laser, a polygon mirror, an F-θ lens etc., and emits a laser light L modulated according to a time-sequential electrical digital image signal of desired image information entered from an unrepresented host apparatus such as an original reading apparatus equipped with a photoelectric converting element such as a CCD, a computer or a word processor, thereby scanning the uniformly charged surface of the rotary photosensitive drum 1. Such scanning exposure with the laser light forms an electrostatic latent image corresponding to the desired image information on the peripheral surface of the rotary photosensitive drum 1.

A developing apparatus 4 employs, in the present embodiment, the two-component contact developing process utilizing developer, consisting of a mixture of highly releasing spherical toner prepared by a polymerization method and showing little transfer residual toner and magnetic carrier, for reversal developing the electrostatic latent image on the photosensitive drum 1 into a toner image.

A transfer apparatus (recording material conveying apparatus) 5 is provided under the photosensitive drum 1, and is of a transfer belt type in the present embodiment. An endless transfer belt 51 (for example a polyimide belt of a thickness of 75 $\mu$m) is supported between a drive roller 52 and an idler roller 53 and is rotated in a forward direction same as the rotating direction of the photosensitive drum 1 with a peripheral speed substantially same as the rotating speed of the photosensitive drum 1.

A transfer charging roller 56, provided inside the transfer belt 51 and serving as a contact transfer charging member (hereinafter represented as transfer roller), presses the upper portion of the transfer belt 51 toward the photosensitive drum 1 to form a transfer portion d. The transfer roller 56 is composed of a conductive roller (metal core) **56*a* connected to a power source E3 and a conductive layer 56*b* formed cylindrically around the outer periphery of the metal core. The transfer roller 56 is positioned parallel with the photosensitive drum 1, and both ends of the metal core 56*a* are rotatably supported by unrepresented bearing members, which are biased by pressing member such as unrepresented springs toward the photosensitive drum 1, whereby the conductive layer 56*b* of the transfer roller 56 is pressed to the surface of the photosensitive drum 1 with a predetermined pressure (80 g/cm in the present embodiment, the pressure measuring method being explained later) to form a transfer nip portion d between the photosensitive drum 1 and the transfer roller 56. The transfer material P conveyed by the sheet conveying system 7, 71 is supplied through the sheet path to the transfer nip portion d in syncyronization with the rotation of the photosensitive drum 1**.

While the recording material P is pinched and conveyed in the transfer nip portion d, the top surface thereof comes into contact with the photosensitive drum 1 while the bear surface is in contact with the transfer roller 56 across the transfer belt (conveyor belt) 51. In such passing, the rear surface of the recording material P is given, by the power source E3, a bias voltage of a polarity opposite to that of the toner, whereby the toner image on the photosensitive drum 1 is transferred onto the top surface of the transfer material P.

In the present embodiment, the conductive layer 56*b* of the transfer roller 56 in the above-described configuration was composed of EPDM, SBR, BR or urethane rubber of open or closed cell structure formed into a roller of a diameter of about 16 mm and a length of about 350 mm so as to have a resistivity of $10^3$ to $10^{10}$ ·Ωcm and a hardness of 5 to 70° (Ascar C).

Figure 14:
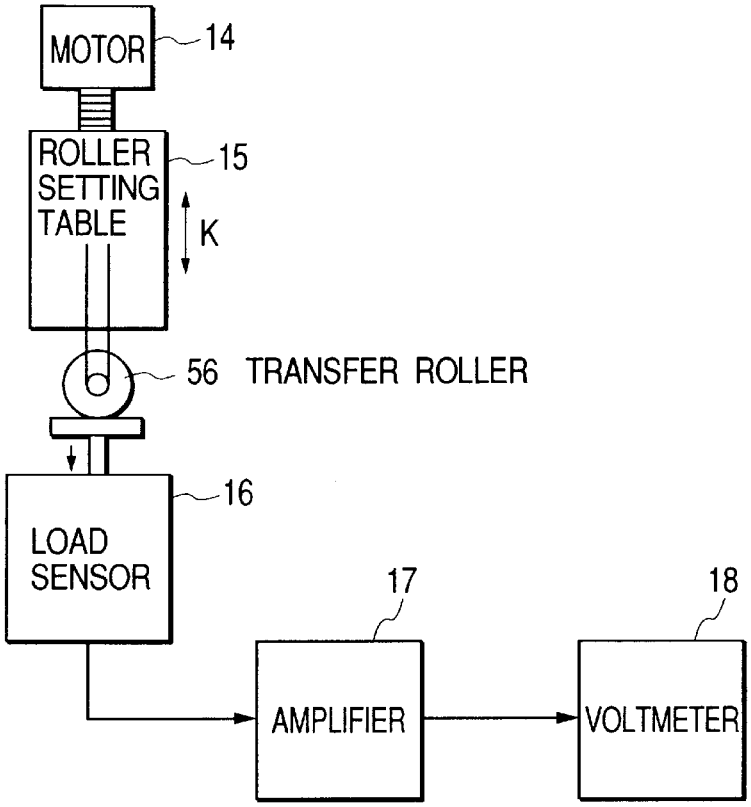
FIG. 14 is a view showing the method of measuring the transfer pressure (line pressure) of a transfer roller.

Now there will be explained the setting of the transfer pressure in case of employing the above-described transfer roller as the contact transfer means, with reference to FIG. 14. A transfer roller setting member 15 is vertically movable, in a direction K, by a motor 14 and a screw rod. The transfer roller 56 is firmly supported by the transfer roller setting member 15. Then the transfer roller setting member 15 is lowered until the transfer roller 56 touches a load sensor 16, and further lowered against the elasticity of the transfer roller 56, whereby the load corresponding to the intrusion amount of the transfer roller 56 can be read as a voltage, by means of the load sensor 16, an amplifier 17 and a voltmeter 18. Then the line pressure per unit length can be obtained by dividing the voltage per unit voltage, determined in advance, with the length of the transfer roller 56. In this manner there is measured the relationship between the intrusion amount of the used transfer roller and the line pressure per unit length (g/cm).

Then the transfer roller 56 is set on the main body of the image forming apparatus, with an intrusion amount corresponding to a desired transfer pressure (line pressure) in a state where the recording medium is present in the transfer portion.

After the transfer step, the transfer belt 51 is cleaned by a cleaning member 55.

The recording material P, subjected to the transfer of the toner image upon passing the transfer nip portion d, is separated in succession from the rotary photosensitive drum 1, then is introduced through a sheet path into a fixing apparatus (for example heat roller fixing apparatus) 8 for fixing of the toner image and is discharged as a print.

An eraser lamp 20 is provided for charge elimination by flush exposure of the surface of the photosensitive drum 1 after the transfer.

The printer of the present embodiment employs the cleanerless process so that there is not provided an exclusive cleaner for eliminating the toner which is not transferred to the recording material P in the transfer nip portion d but remains on the photosensitive drum 1, but the transfer residual toner passes the position of the corona charging apparatus 2 by the subsequent rotation of the photosensitive drum 1 and is collected in the developing apparatus 4, whereby the photosensitive drum 1 is used in repetition for image formation.

(2) Developing apparatus 4

The toner development for the electrostatic latent image is generally classified into the following four methods a to d:

a. a method of coating non-magnetic toner for example with a blade on a sleeve or magnetic-toner magnetically on a sleeve and executing development in a non-contact state with the photosensitive member (one-component non-contact development);

b. a method of development with thus coated toner, in contact with the photosensitive member (one-component contact development);

c. a method of magnetically carrying developer consisting of a mixture of toner particles and magnetic carrier particles and executing development in contact with the photosensitive member (two-component contact development); and d. a method of development with the above-mentioned two-component developer in a non-contact state (two-component non-contact development).

Among these methods, the two-component contact development c is widely utilized in consideration of high quality and stabililty of the image.

Figure 15:
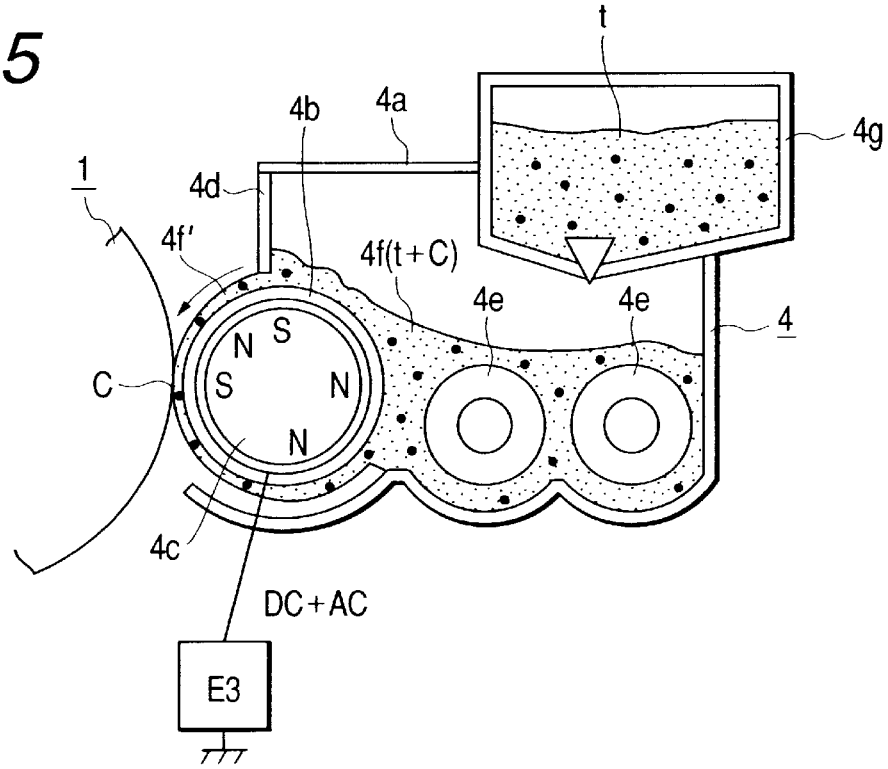
FIG. 15 is a magnified schematic view of a part including a developing apparatus.

FIG. 15 is a magnified schematic cross-sectional view of the developing apparatus 4 employed in the present embodiment, which is a reversal developing apparatus of two-component magnetic brush contact development type employing developer consisting of a mixture of highly releasing non-magnetic spherical toner prepared by a polymerization process and magnetic carrier (developing magnetic particles, developing carrier) and in which such developer is supported as a magnetic brush layer on a developer bearing member (developing member, developing device) by a magnetic force and is carried to the developing portion for contacting the surface of the photosensitive drum for developing the electrostatic latent image as a toner image.

There are shown a developing container 4*a*, a developing sleeve 4*b* serving as a developer bearing member, a magnet (magnet roller) 4*c* fixed inside the developing sleeve 4*b* and serving as magnetic field generating means, a developer thickness regulating blade 4*d* for forming a thin layer of the developer on the surface of the developing sleeve, a screw 4*e* for agitating and carrying the developer, and a two-component developer 4*f* contained in the developing container 4*a* and composed of a mixture of non-magnetic toner t and magnetic carrier C.

The developing sleeve 4*b* is so positioned that the shortest distance (gap) to the photosensitive drum 1 is about 500 μm at least at the developing operation, whereby the thin layer 4*f'* of the magnetic brush of the developer borne on the external periphery of the developing sleeve 4*b* comes into contact with the surface of the photosensitive drum 1. The contact portion between the developer magnetic brush layer 4*f'* and the photosensitive drum 1 is the developing area (developing portion) c.

The developing sleeve 4*b* is rotated counterclockwise, as indicated by an arrow, with a predetermined rotating speed outside the fixed magnet roller 4*c*, and, in the developing container 4*a*, a magnetic brush of the developer 4*f* (t+C) is formed on the external periphery of the sleeve by the magnetic force of the magnet roller 4*c*.

The magnetic brush of the developer is carried together with the rotation of the sleeve 4*b*, then regulated in thickness by the blade 4*d*, and brought out from the developing container as a thin layer developer magnetic brush 4*f'* of a predetermined thickness to the developing portion c. After contacting the photosensitive drum 1 therein, the magnetic brush is carried back again into the developing container 4*a* by the subsequent rotation of the sleeve 4*b*.

The developing sleeve 4*b* receives, from a developing bias source E3, a predetermined bias consisting of superposed DC and AC components. In the present embodiment, the developing characteristics were such that a fog was generated when the difference between the charged potential (−700 V) of the photosensitive drum and the DC component of the developing bias was 200 V or less and that the developing carrier C was deposited to the photosensitive drum 1 when the difference was 350 V. Therefore the DC component of the developing bias was selected as −400 V.

The toner concentration (mixing ratio with the carrier C) of the developer 4*f* in the developing container 4*a* gradually decreases by the consumption of the toner in the development of the electrostatic latent image. The toner concentration of the developer 4*f* in the developing container 4*a* is detected by unrepresented detecting means, and, when it is lowered to a predetermined lower permissible limit, the toner t is replenished into the developer 4*f* in the developing container 4*a* from a toner replenisher 4*g*, whereby the toner concentration of the developer 4*f* in the developing container 4*a* is always maintained within a predetermined permissible range.

(3) Cleanerless process and prevention of pass-through ghost

Since the printer of the present embodiment is based on the cleanerless process, the transfer residual toner, which remains on the photosensitive drum 1 after the transfer of the toner image onto the recording material P, upon reaching the corona charging area of the photosensitive drum 1, is charged again in a polarity same as that of the primary charging (negative in the present embodiment) simultaneously with the primary charging. Then, upon reaching the developing portion c, such toner is collected by the cleaning simultaneous with development, by the developing sleeve 4*b* of the developing apparatus 4 based on the fog-eliminating electric field at the developing operation. In this manner the transfer residual toner is collected into the developing apparatus 4 and is used in the next or subsequent image forming cycle, whereby the waste toner is not generated. Also such process is advantageous in space, allowing a significant compactization of the image forming apparatus.

The use of the highly releasing spherical toner prepared by a polymerization process as the toner in the developer allows to reduce the amount of generation of the transfer residual toner. Also the use of the developing apparatus 4 of the two-component contact development system improves the collection of the transfer residual toner into the developing apparatus 4 by so-called scraping effect thereof.

However, in the image forming apparatus of the above-described configuration, the cleanerless system failed because of the generation of the pass-through ghost phenomenon in the actual image forming operation as explained in the foregoing.

In the present embodiment, every means were tried to prevent the pass-through ghost which is specific to the cleanerless system. Some means were effective in preventing the pass-through ghost, but resulted in the generation of other image defects or in a significant increase in the cost and the prevention of such newly found drawbacks could not be compatible with the prevention of the pass-through ghost.

Nevertheless, based on the intensive investigation of the present inventors, the pressure of the contact transfer charging member 56 was determined as will be explained in the following to realize an ideal system, capable of preventing the generation of the pass-through ghost and free from other drawbacks mentioned above. The details of such system will be detailed in the following.

Figure 16:
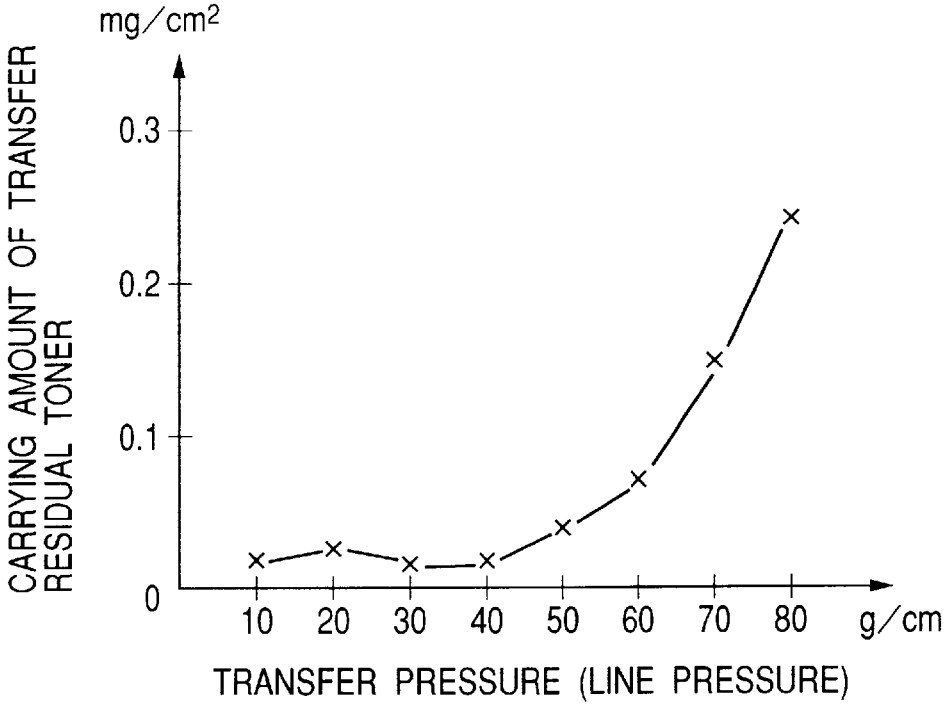
FIG. 16 is a chart showing the relationship between the transfer pressure and the carrying amount of the transfer residual toner.

Based on the aforementioned knowledge that the pass-through ghost is correlated with the residual toner amount per unit area, the relationship between the transfer pressure and the transfer residual toner was investigated to obtain a result shown in FIG. 16.

The result shown in FIG. 16 indicates that the transfer pressure is correlated with the transfer residual toner and that the carried amount of the transfer residual toner can be reduced by a decrease in the transfer pressure.

Figure 17:
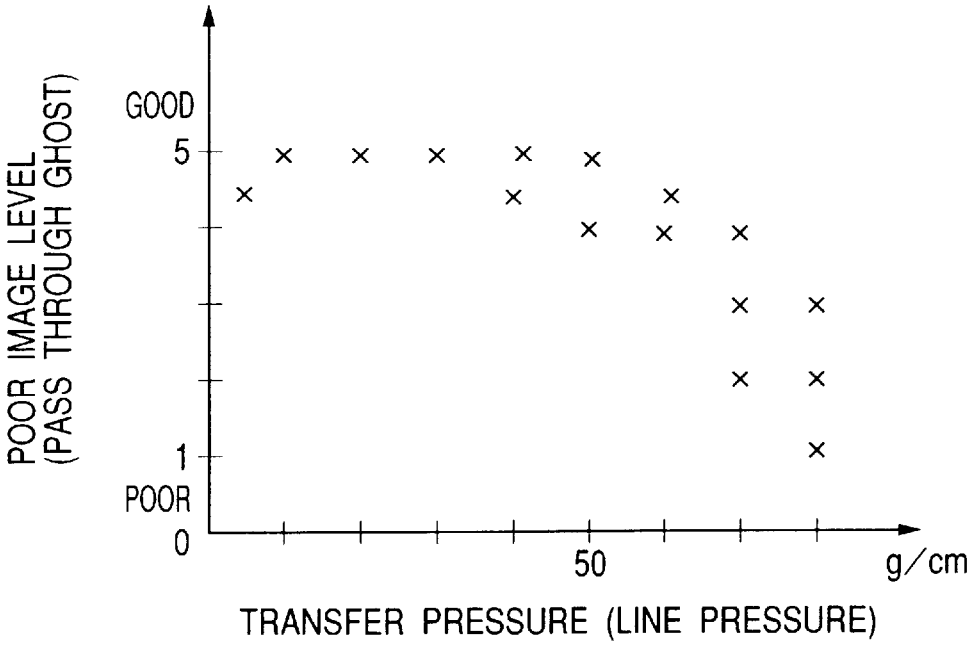
FIG. 17 is a chart showing the relationship between the transfer pressure and the image defect (pass-through ghost)

FIG. 17 also shows the relationship between the transfer pressure (line pressure) and the pass-through ghost.

As will be anticipated from the result in FIG. 17, there is also a relationship between the transfer pressure and the pass-through ghost and the pass-through ghost phenomenon could be significantly reduced by lowering the transfer pressure from the currently employed value.

The result in FIG. 16 indicates that the transfer residual toner remains a certain low level even when the transfer pressure is lowered, but such toner presumably results from the Van der Waals force or the mirror reflection force between the developing toner and the surface of the photosensitive drum and is in a level acceptable to the image or the pass-through ghost in consideration of the results shown in FIGS. 16 and 17.

The above-mentioned relationship between the transfer pressure and the pass-through ghost is being investigated for its cause, and the mechanism of such relationship will be clarified in the future.

Figure 27:
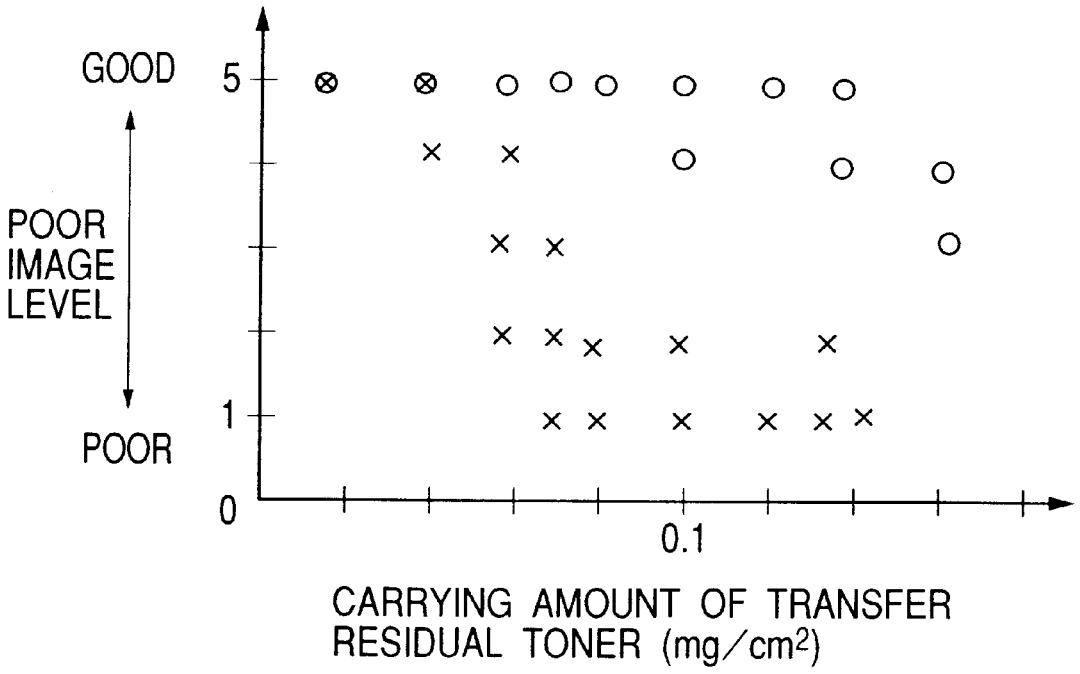
FIG. 27 is a chart showing the relationship between the carrying amount of the transfer residual toner and the level of image defect.
Figure 28A:
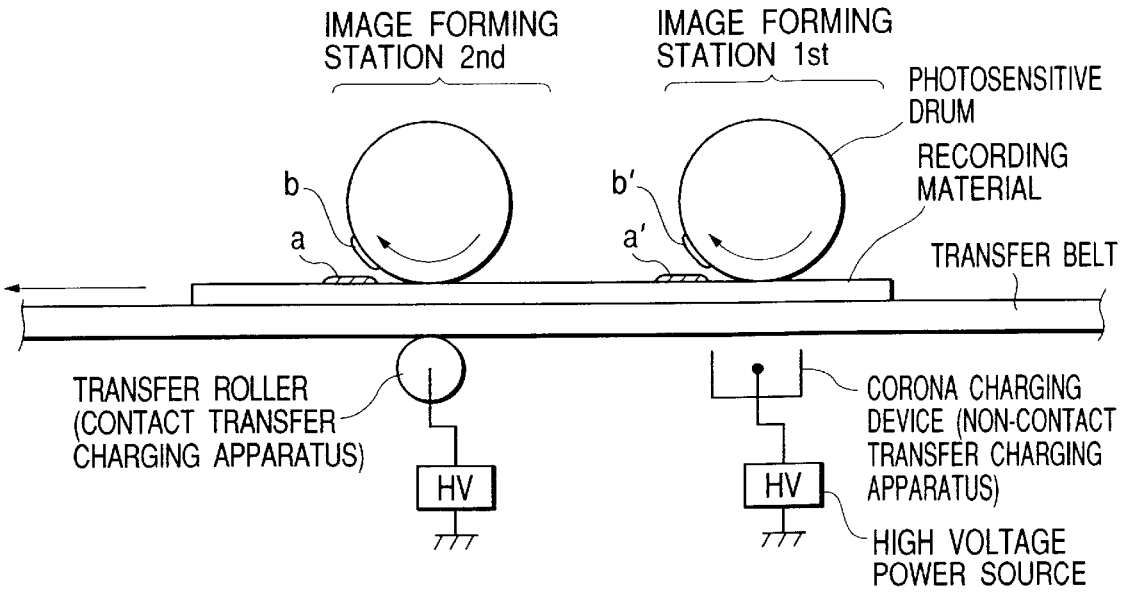
FIGS. 28A and 28B are views showing the principle of generation of color hue variation in a color image forming apparatus.
Figure 28B:
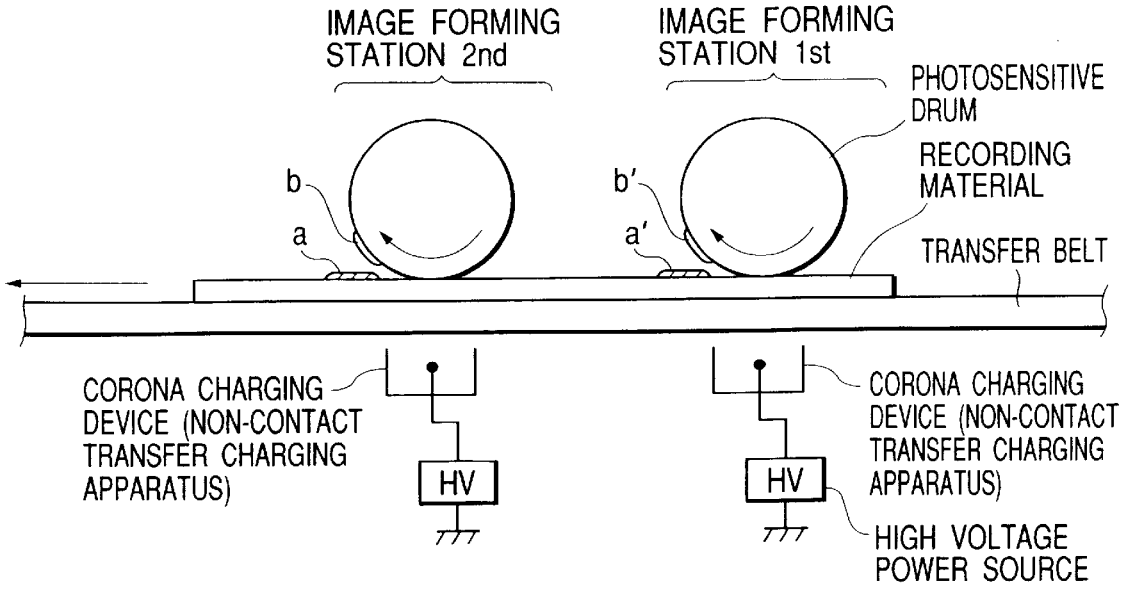

In this situation, the upper limit of the carried amount of the transfer residual toner in consideration of the pass-through ghost based on the data shown in FIG. 27 is about 0.06 mg/cm$^2$. Therefore the comparison of FIGS. 27 and 16 suggests that the generation of the pass-through ghost can be almost suppressed if the transfer pressure does not exceed 60 g/cm in line pressure. Again referring to FIG. 17, the pass-through ghost certainly starts to appear about when the transfer pressure exceeds 60 g/cm, but the ghost is scarcely present if the transfer pressure is lower than 60 g/cm. For a marginal safety, the transfer pressure is preferably equal to or less than 50 g/cm, and more preferably equal to or less than 40 g/cm.

On the other hand, a line pressure of 1 g/cm at minimum is required for the transfer pressure, since, at a transfer pressure of 0 g/cm, there was observed transfer skipping, presumably caused by the unstable or non-uniform transfer pressure.

Based on the foregoing, in an image forming apparatus employing the cleanerless system and the contact transfer charging means, it is rendered possible to suppress the image defect resulting from the pass-through ghost and to achieve satisfactory image formation in stable manner, by maintaining the transfer pressure not less than 1 g/cm and not more than 60 g/cm, preferably not exceeding 50 g/cm and more preferably not exceeding 40 g/cm.

Figure 18:
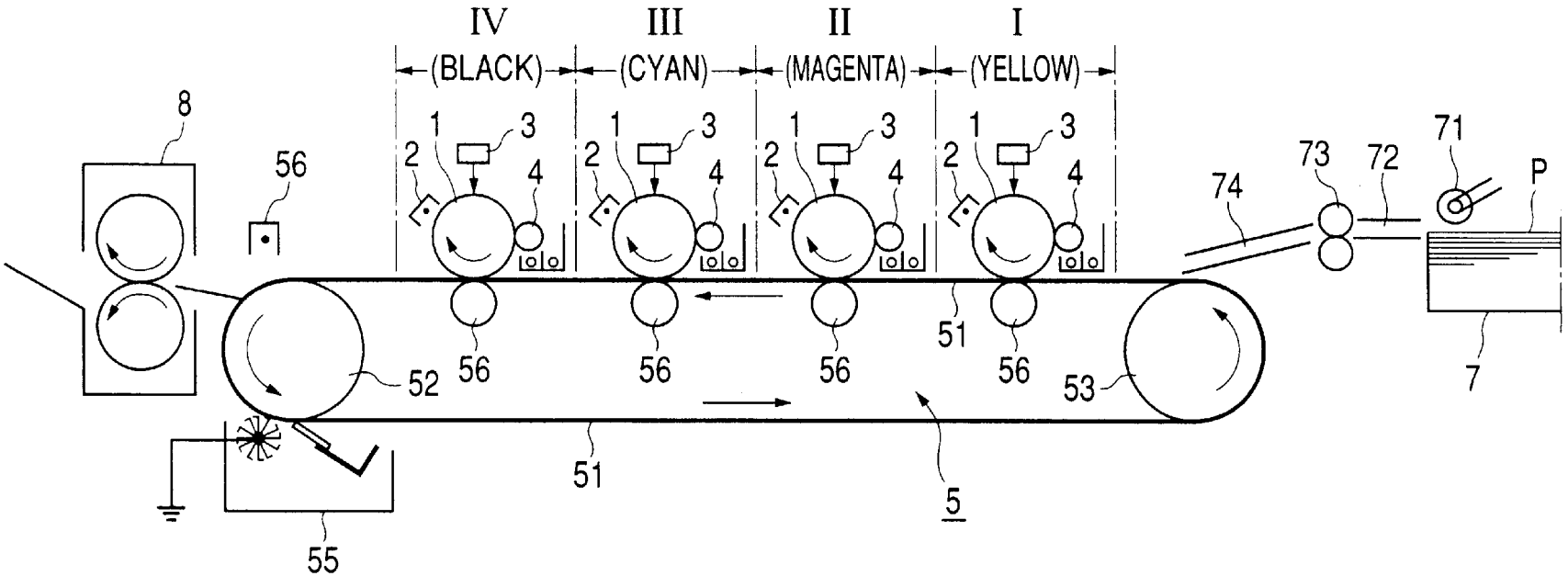
FIG. 18 is a schematic view showing the configuration of an image forming apparatus constituting a sixth embodiment.
Figure 19:
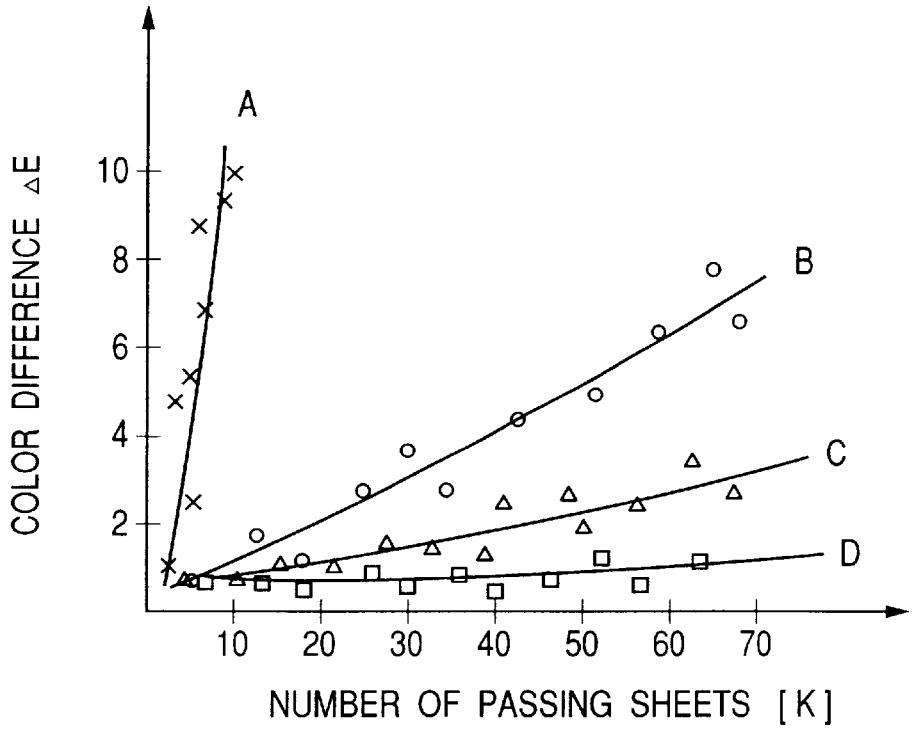
FIG. 19 is a chart showing the relationship between the number of passed sheets and the color difference.
Figure 20:
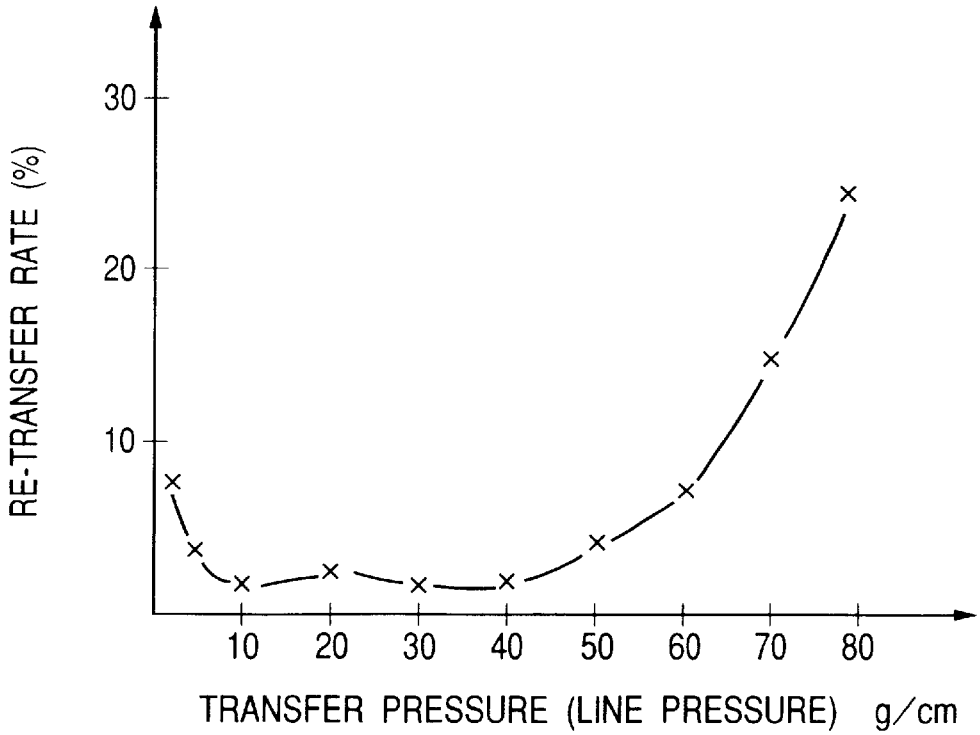
FIG. 20 is a chart showing the relationship between the transfer pressure and the re-transfer rate.

(sixth embodiment) (FIGS. 18 to 20)

The present embodiment defines the line pressure of the contact transfer charging member, in order to resolve the aforementioned variation in the color hue, as will now be explained in detail.

FIG. 18 shows an image forming apparatus of the present embodiment, which is a four-color tandem printer having four image forming portions I, II, III, IV in succession, similarly to the image forming apparatus of the foregoing fourth embodiment (FIG. 12). However each of the image forming portions I, II, III, IV is a laser beam printer based on the electrophotographic process of transfer type, the cleanerless process and the contact transfer charging process as in the image forming apparatus of the foregoing fifth embodiment.

The developer employed in the present embodiment is a two-component developer consisting of a mixture of polymerization toner prepared by suspension polymerization and having ester wax in the core, styrene-butylacrylate in the resin layer and styrene polyester in the surface layer, and magnetic resin carrier prepared by a polymerization process.

The transfer belt 51 (recording material conveyor belt) employed in the present embodiment is composed of polyimide resin containing carbon for resistance adjustment, but it may also be composed of various polymers or elastomers such as polyethylene terephthalate resin, polyfluorovinylidene resin, polycarbonate resin or polyurethane resin.

A frame member (not shown) for supporting the transfer conveying means is provided with two rollers, namely a drive roller 52 for driving the belt by friction and a tension roller 53 for giving a predetermined tension to the transfer belt 51. The transfer conveying means is so constructed as to be capable of a rocking motion about the drive roller 52 thereby contacting with or separating from the photosensitive drum 1 serving as the image bearing body, and is in the contact position with the photosensitive drum only during the image forming operation and drives the transfer belt 51 at a running speed same as the peripheral speed of the photosensitive drum 1 to convey the recording material, whereby the toner image formed on the photosensitive drum 1 is transferred onto the recording material P by a transfer roller 56 constituting transfer means and opposed to the photosensitive drum 1. The transfer roller 56 employed in the present embodiment is similar to that explained in the foregoing fifth embodiment and will not, therefore, be explained further.

In the tandem color image forming apparatus employing the cleanerless system in each of the image forming portions I, II, III, IV, the use of the transfer roller 56 of contact type as the transfer charging member results in a variation in the color hue by the re-transfer phenomenon, whereby the desired image cannot be obtained as explained in the foregoing.

Figure 29:
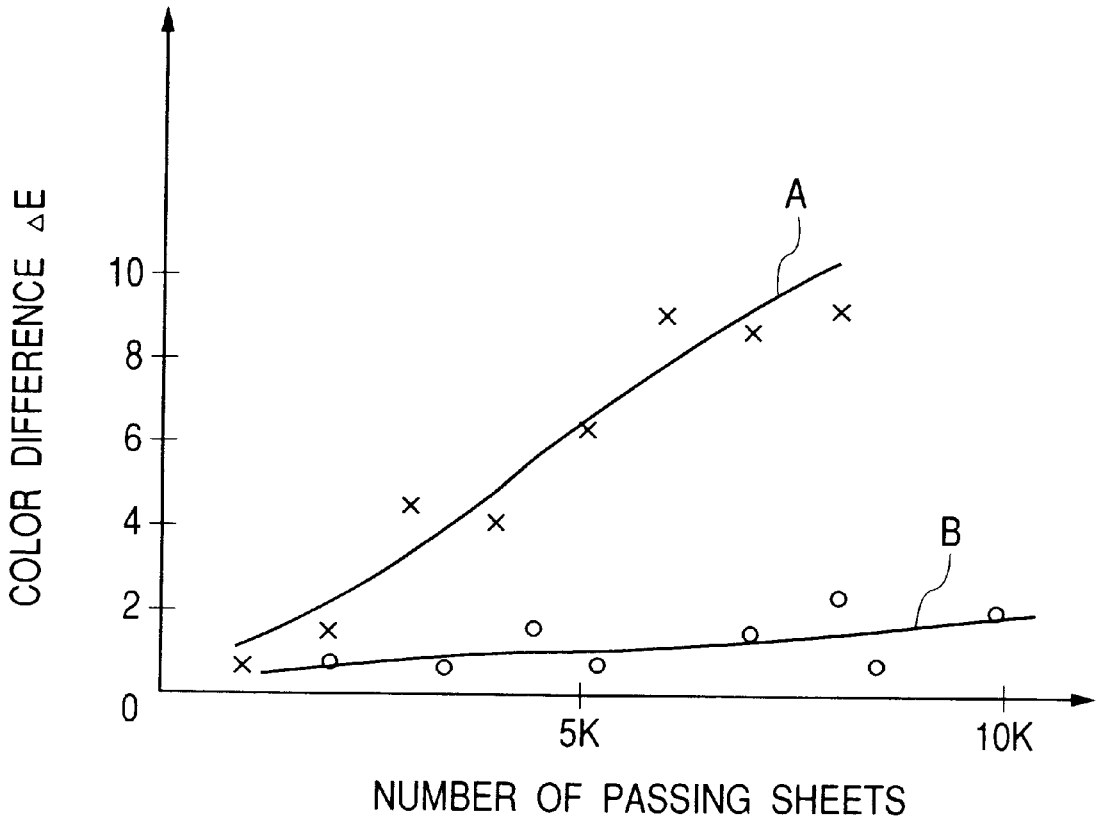
FIG. 29 is a chart showing the relationship between the number of passed sheets and the color difference.

Therefore, in order to clarify the difference of the aforementioned A and B shown in FIG. 29, the values of A and B were measured again according to the aforementioned definition of the re-transfer rate. The obtained results showed a large difference:

A: $\eta rtr=20\%$

B: $\eta rtr=4\%$

In the configuration of the present embodiment based on the cleanerless system, the variation in the color hue evidently becomes larger as the content of the re-transfer toner increases in the transfer residual toner collected in the developing portion. Therefore the apparent hue variation as shown by A in FIG. 29 is ascribed to an increase in the amount of the re-transfer toner. This phenomenon cannot occur in the presence of a cleaning member for cleaning the photosensitive drum 1, and can be considered a drawback specific to the cleanerless system.

From the foregoing, it is concluded that, in the color image forming apparatus, a variation in the hue exceeding the permissible range is caused by the mixing of the re-transfer toner into the developing apparatus, resulting from the combined use of the toner recycle system in the development and the contact transfer charging member.

In the present embodiment, every means were tried to prevent the variation in the color hue which is specific to the cleanerless system. Some means were effective in preventing the hue variation, but resulted in the generation of other image defects or in a significant increase in the cost and the prevention of such newly found drawbacks could not be compatible with the prevention of the hue variation.

Nevertheless, based on the intensive investigation of the present inventors, the pressure of the contact transfer charging member 56 was determined as will be explained in the following to realize an ideal system, capable of preventing the generation of the hue variation and free from other drawbacks mentioned above. The details of such system will be detailed in the following.

FIG. 19 shows the relationship between the line pressure of the contact transfer charging member and the hue variation (color difference) resulting with an increase in the number of image formations. In FIG. 19, four lines respectively indicate:

A: transfer pressure 80 g/cm

B: transfer pressure 60 g/cm

C: transfer pressure 50 g/cm

D: transfer pressure 40 g/cm.

Referring to FIG. 19, a case A shows an extremely large color difference with the increase of image formations, exceeding the upper limit value 6.5 of the color difference, where the difference is acceptable as a same color in impression, at about 5000 image formations. In such situation, the re-transfer rate is also as large as 25% as shown in FIG. 20. On the other hand, a case B shows a smaller variation of color hue, and the color difference value of 6.5 is exceeded at least after 50000 image formations. These results clearly indicate that the color difference is closely correlated with the transfer pressure.

FIG. 20 shows the result of an investigation based on the result shown in FIG. 19, and shows the relationship between the line pressure of the contact transfer charging member 56 toward the photosensitive drum and the re-transfer rate. The measuring method for the line pressure is as explained in the foregoing fifth embodiment and will not be explained again. The result shown in FIG. 20 indicates that a lowering in the transfer pressure also reduces the re-transfer rate, supporting the result shown in FIG. 19 and also indicating that the transfer pressure is closely correlated with the color hue variation. The above-mentioned relationship between the transfer pressure and the hue variation is being investigated for its cause, and the mechanism of such relationship will be clarified in the future.

The photosensitive drum, developer etc. employed in the present embodiment are generally to be replaced after about 50000 image formations, and, taking 50000 image formations as a threshold value, the transfer pressure has to be 60 g/cm or less, preferably 50 g/cm or less, and more preferably 40 g/cm or less.

On the other hand, a line pressure of 1 g/cm at minimum is required for the transfer pressure, since an extremely low transfer pressure deteriorates the stability of the transfer operation, leading to an increase of the re-transfer amount, as will be apparent from FIG. 20.

Based on the foregoing, in an image forming apparatus employing the cleanerless system and the contact transfer charging member, it is rendered possible to suppress the image defect resulting from the color hue variation specific to the cleanerless system and to achieve satisfactory image formation in stable manner, by maintaining the transfer pressure not less than 1 g/cm and not more than 60 g/cm, preferably not exceeding 50 g/cm and more preferably not exceeding 40 g/cm.

(seventh embodiment) (FIGS. 21 to 25)

The present embodiment is to prevent the pass-through ghost and the color hue variation by employing a transfer blade as the contact transfer charging system. The configuration is same as that of the foregoing fifth and sixth embodiments, except that the transfer roller 56 constituting the contact transfer charging member is replaced by a transfer blade 54. Except for the change in the contact transfer charging member, the configuration remains same and will not be explained further.

Figure 5:
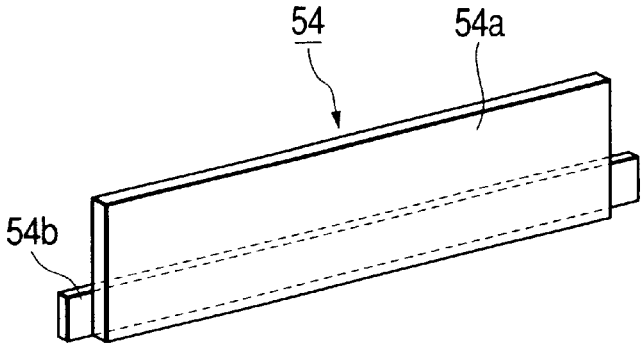
FIG. 5 is an external perspective view of a transfer blade.

The transfer blade 54 of the present embodiment is composed, like the transfer blade 54 shown in FIG. 5, of a base member 54*a* of conductive electrode 54*b* provided along the lower end portion of a surface of the base member 54*a*, is so positioned that the longitudinal direction of the base member 54*a* is substantially perpendicular (thrust direction) with the conveying direction of the recording material, and is pressed to the photosensitive drum 1 across the recording material or across the recording material and the conveying belt, with a line pressure of 120 g/cm.

The base member 54*a* can be composed in general of a rubber material such as isoprene rubber, styrene rubber, butadiene rubber, nitrile rubber, ethylenepropylene rubber, butyl rubber, silicone rubber, chloroprene rubber, chlorosulfonated polyethylene, acrylic rubber, hydrine rubber, urethane rubber or fluorinated rubber, or synthetic rubber consisting of a composite of such rubber materials, or a synthetic resinous material such as nylon, polyurethane or polyester containing a conductivity providing agent such as tin oxide or carbon black, having a resistivity of 10 to $10^{10}\cdot\Omega$cm and a hardness of 5 to 80° (JIS-A). In the present embodiment, there was employed a transfer blade 54 of a resistivity of $\mathbf{10}^5$ to $10^7$ Ωcm and a hardness of 50 to 70°, with a thickness of about 2 mm. Each of the transfer blades is connected to an unrepresented high voltage source.

Figure 26:
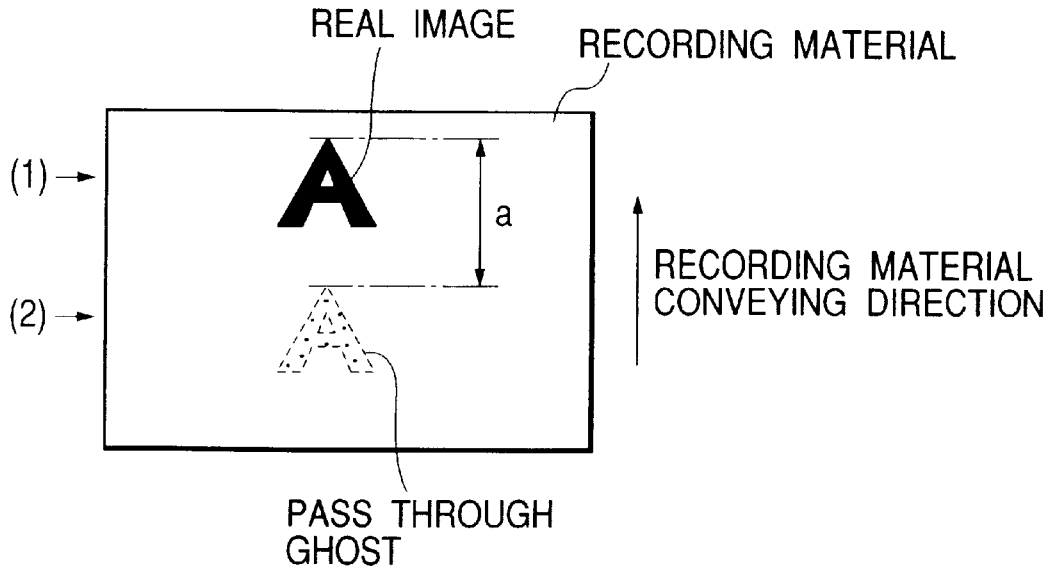
FIG. 26 is a view showing the principle of generation of pass-through ghost.

The configuration of the fifth embodiment with the blade of the above-described conditions as the contact transfer charging member provided satisfactory image formation with the pass-through ghost in the image shown in FIG. 26.

Figure 21:
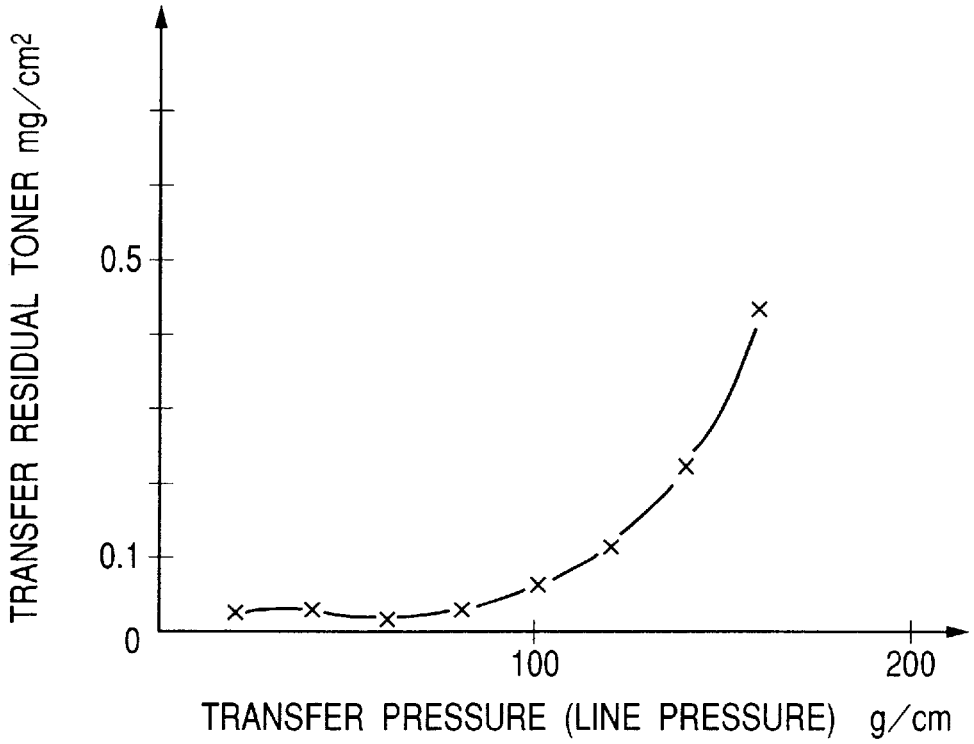
FIG. 21 is a chart showing the relationship between the transfer pressure and the transfer residual toner in a seventh embodiment.
Figure 22:
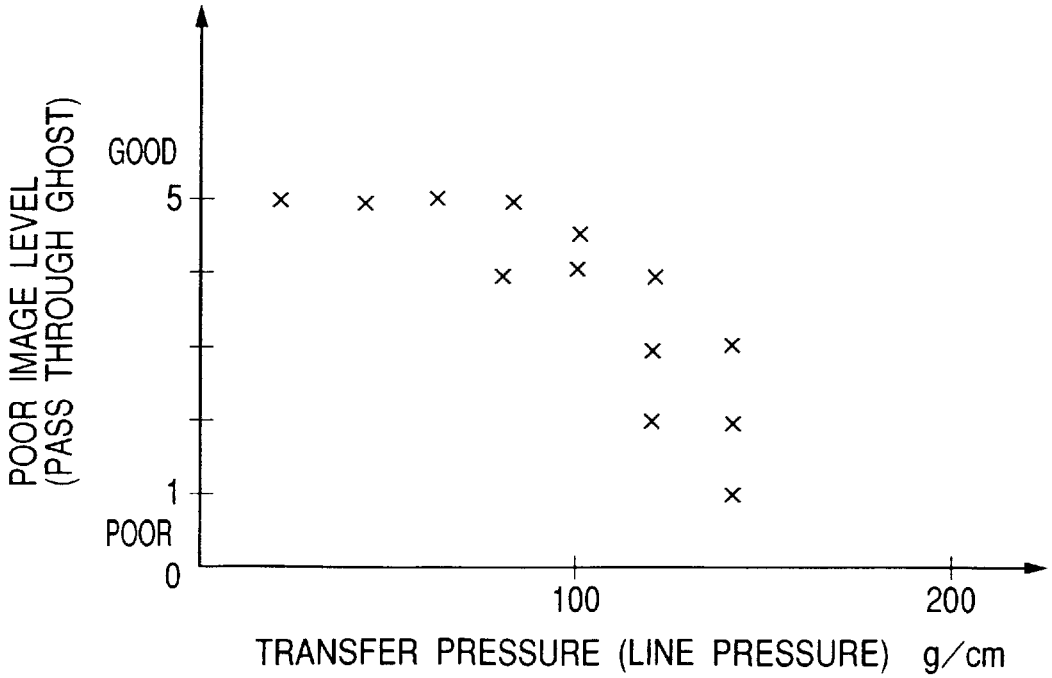
FIG. 22 is a chart showing the relationship between the transfer pressure and the image defect (pass-through ghost)

Also in the configuration of the present embodiment, there were investigated, as shown in FIGS. 16 and 17, the amount of the transfer residual toner and the relationship between the transfer pressure and the amount of the transfer residual toner to obtain the results shown in FIGS. 21 and 22.

FIGS. 21 and 22 indicate that the configuration employing the transfer blade 54 reduces the amount of the transfer residual toner and does not show the pass-through ghost phenomenon. Also the pass-through ghost did not occur even at or above a line pressure of 70 g/cm where the pass-through ghost was generated in case of the transfer roller 56, thus indicating that the transfer blade has a wider margin in the upper limit of the transfer pressure in comparison with the transfer roller.

As the results in FIGS. 21 and 22 indicate the generation of the pass-through ghost when the transfer pressure increases to about 100 g/cm or higher, it is preferable to set the transfer pressure at 100 g/cm or lower.

Also as the results in FIGS. 21 and 22 indicate that the carried amount of the transfer residual toner the generation of the pass-through ghost become less, the transfer blade pressure is more preferably selected at 80 g/cm or lower.

Figure 23:
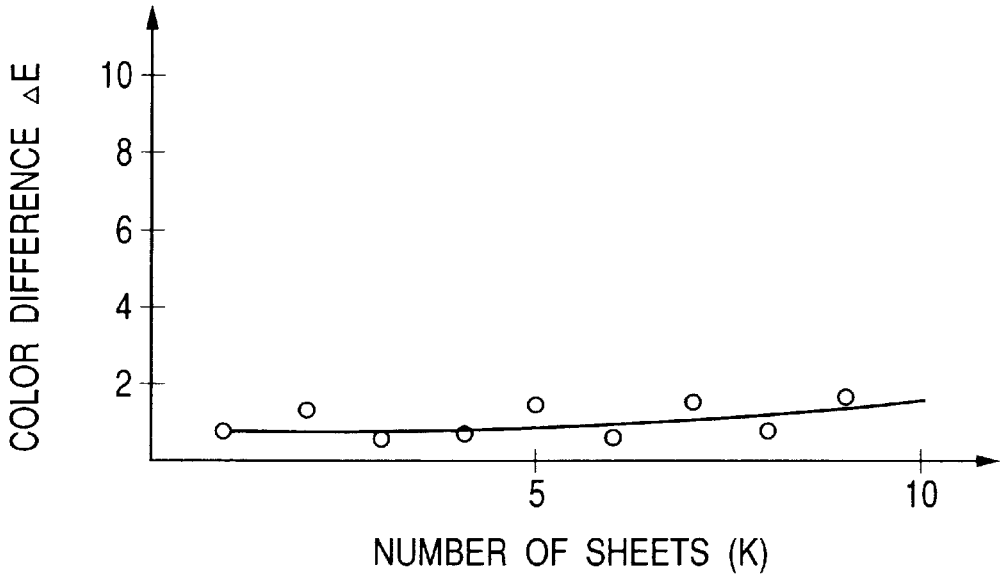
FIG. 23 is a chart showing the relationship between the number of passed sheets and the color difference.

Also the configuration of the sixth embodiment with the blade of the above-described conditions as the contact transfer charging member provided, in an investigation as shown in FIG. 29, a result shown in FIG. 23. The result in FIG. 23 indicates a smaller color difference and a reduced generation of the hue variation, in comparison with the result in FIG. 29, obtained with the transfer roller of a same line pressure.

Figure 24:
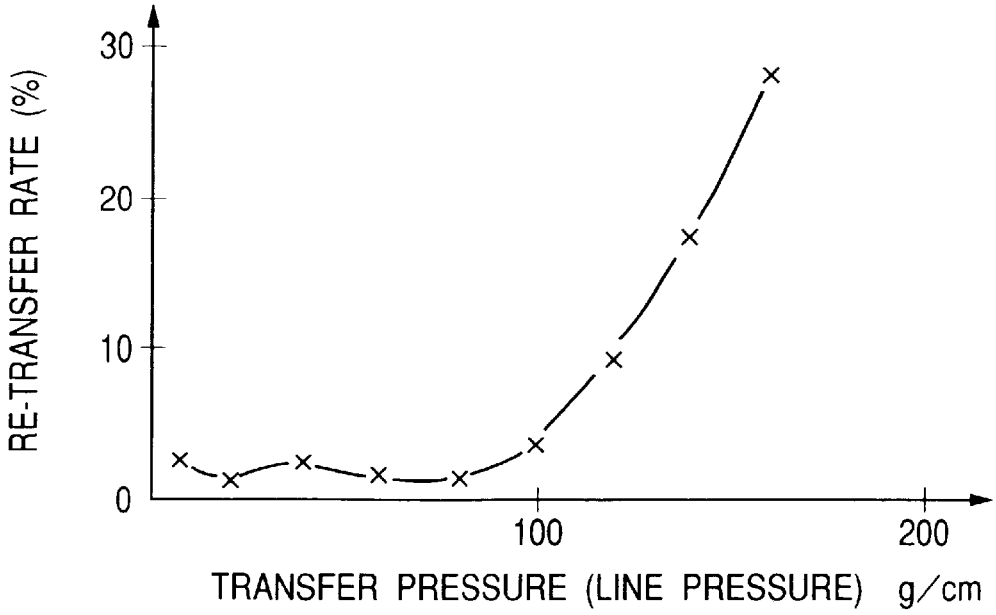
FIG. 24 is a chart showing the relationship between the transfer pressure and the re-transfer rate.

Then, the investigation of the re-transfer rate according to the aforementioned definition as in FIG. 20 provided a result shown in FIG. 24. The result in FIG. 24 indicates that the use of the transfer blade reduces the re-transfer amount to 5% or less even at a line pressure of 80 g/cm at which the re-transfer rate was in excess of 20% in case of the transfer roller, thus indicating a wider margin in the upper limit of the transfer pressure for the re-transfer rate in comparison with the transfer roller. The measuring method for the line pressure is same as in the first or fifth embodiment and will not be explained again.

However, FIG. 24 also indicates that the re-transfer amount increases when the transfer pressure exceeds about 100 g/cm even with the transfer blade, so that the transfer pressure is preferably selected at 100 g/cm or lower.

Based on the foregoing results, an investigation similar to FIG. 19 was conducted by varying the transfer pressure as follows:

A: transfer pressure 120 g/cm

B: transfer pressure 100 g/cm

C: transfer pressure 80 g/cm

Figure 25:
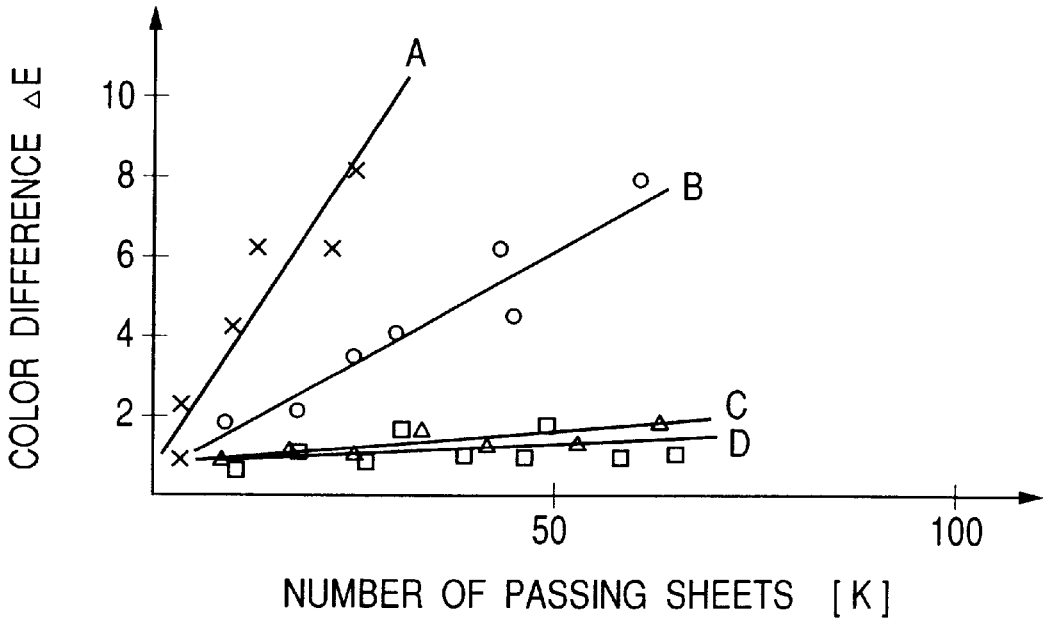
FIG. 25 is a chart showing the relationship between the number of passed sheets and the color difference.

D: transfer pressure 60 g/cm.

as shown in FIG. 25, which shows the relationship between the number of image formations and the color difference.

Referring to FIG. 25, a case A shows an extremely large color difference with the increase of image formations, exceeding the upper limit value 6.5 of the color difference, where the difference is acceptable as a same color in impression, at about 20000 image formations. In such situation, the re-transfer rate is also as large as 10% as shown in FIG. 24.

On the other hand, a case B shows a smaller color difference in comparison with the case A, and the color difference value of 6.5 is exceeded at least after 50000 image formations.

Also cases C and D show even smaller color differences in comparison with the cases A and B. The results of the cases C and D almost overlap mutually, and this fact can be probably ascribable to a fact shown in FIG. 24 that the re-transfer rate scarcely changes in a range where the transfer pressure is equal to or lower than 80 g/cm.

The photosensitive drum, developer etc. employed in the present embodiment are generally to be replaced after about 50000 image formations, and, taking 50000 image formations as a threshold value, the transfer pressure has to be 100 g/cm or less in order to attain the desired targets.

Also according to FIGS. 24 and 25, a blade transfer pressure equal to or less than 80 g/cm shows a lower re-transfer rate and a smaller color difference as a function of the number of image formations, so that the transfer blade pressure is more preferably selected at 80 g/cm or less.

On the other hand, a line pressure of 1 g/cm at minimum is required for the transfer pressure also in case of the blade transfer, since, at a transfer pressure of 0 g/cm, there was observed transfer skipping, presumably cuased by the unstable or non-uniform transfer pressure.

The above-mentioned superiority of the transfer blade to the transfer roller against the pass-through ghost and the color hue variation is being investigated for its cause, and its mechanism will be clarified in the future.

Based on the foregoing, in an image forming apparatus employing the cleanerless system and the contact transfer charging member of blade type, it is rendered possible to suppress the image defect resulting from the pass-through ghost and the color hue variation specific to the cleanerless system and to achieve satisfactory image formation in stable manner, by maintaining the transfer pressure not less than 1 g/cm and not more than 100 g/cm, preferably not exceeding 80 g/cm.

The present invention has been explained by embodiments thereof, but the present invention is by no means limited to such embodiments and is subject to various modifications within the scope and spirit of the appended claims.

What is claimed is:

1. An image forming apparatus comprising:

an image bearing body, a surface of which includes a photosensitive body having a hardness in the range of 100 to 500 $N/mm^2$;

charging means for charging said image bearing body;

wherein said charging means includes magnetic charging particles are in friction contact with said image bearing body, thereby charging said image bearing body, and a supporting member for holding the magnetic charging particles with a magnetic force;

exposing means for forming an electrostatic image by image exposing said image bearing body, which is charged by said charging means;

developing means for developing the eletrostatic image on said image bearing body; and transfer means for transferring a developed image onto a transfer material and being in pressure contact with said image bearing body, wherein a pressure of the transfer material to said image bearing body is not less than 1 g/cm and not more than 100 g/cm in line pressure.

2. An image forming apparatus according to claim 1, wherein said charging means includes a magnet for magnetically holding the magnetic charging particles.

3. An image forming apparatus according to claim 1, wherein the magnetic charging particles are formed by a crushing and granulating method.

4. An image forming apparatus according to claim 1, wherein said charging means charges a surface of said image bearing body bearing developer remaining after transfer.

5. An image forming apparatus according to claim 1, wherein said charging means executes injection charging of said image bearing body.

6. An image forming apparatus according to claim 5, wherein a charge injection layer is formed on said image bearing body.

7. An image forming apparatus according to claim 1, wherein said transfer means includes a pressing member for pressing a rotary transfer member to said image bearing body.

8. An image forming apparatus according to claim 7, wherein said pressing member is roll-shaped.

9. An image forming apparatus according to claim 7, wherein said pressing member is blade-shaped.

10. An image forming apparatus according to claim 1, wherein the line pressure is equal to or more than 1 g/cm and equal to or less than 80 g/cm.

11. An image forming apparatus according to claim 1, wherein the line pressure is equal to or more than 1 g/cm and equal to or less than 60 g/cm.

12. An image forming apparatus according to claim 1, wherein the line pressure is equal to or more than 1 g/cm and equal to or less than 50 g/cm.

13. An image forming apparatus according to claim 1, wherein the line pressure is equal to or more than 1 g/cm and equal to or less than 40 g/cm.

* * * * *

UNITED STATES PATENT AND TRADEMARK OFFICE

CERTIFICATE OF CORRECTION

PATENT NO. : 6,496,673 B2
DATED : December 17, 2002
INVENTOR(S) : Yuji Bessho

It is certified that error appears in the above-identified patent and that said Letters Patent is hereby corrected as shown below:

Column 4,
Line 6, “state” should read -- station --.

Column 7,
Line 24, “arrow,” should read -- an arrow, --.

Column 8,
Line 14, “transfer” should read -- transfer apparatus --.

Column 12,
Line 57, “polyetheretherketone,” should read -- polyether ketone --.

Column 13,
Line 67, “(charger)22.” should read -- (charger) 22. --.

Column 14,
Line 17, “obtained” should read -- is obtained --.

Column 15,
Line 18, “weaked” should read -- weakened --;
Line 19, “charged” (first occurrence) should be deleted; and
Line 40, “alined” should read -- aligned --.

Column 16,
Line 23, “flow” should read -- flows --;
Line 43, “fo” should read -- of --;
Line 53, “case” should read -- case of --; and
Line 55, “different” should read -- difference --.

Column 17,
Line 22, “increase” should read -- increases --.

Column 18,
Line 6, “showen in FIG. 9, which shows the depth of blemishes” should be deleted.

Column 19,
Line 28, “same” should read -- the same --.

UNITED STATES PATENT AND TRADEMARK OFFICE

CERTIFICATE OF CORRECTION

PATENT NO. : 6,496,673 B2
DATED : December 17, 2002
INVENTOR(S) : Yuji Bessho

It is certified that error appears in the above-identified patent and that said Letters Patent is hereby corrected as shown below:

Column 20,
Line 30, “same” should read -- the same --; and
Line 38, “the a” should read -- the --.

Column 21,
Line 62, “photosensitive” should read -- photosensitive member --.

Column 22,
Line 44, “same” should read -- the same --; and
Line 66, “syncronization” should read -- synchronization --.

Column 23,
Line 26, “further” should read -- is further --.

Column 26,
Line 13, “remains” should read -- remains at --.

Column 27,
Line 19, “same” should read -- the same --.

Column 28,
Line 64, “same” should read -- the same --.

Column 29,
Line 1, “same” should read -- the same --;
Line 5, “conductive electrode” should read -- conductive polyethylene of a rectangular plate shape, and a conductive --;
Line 25, “$\mathbf{10^5}$” should read -- $10^5$ --;
Line 43, “case” should read -- the case --;
Line 52, “toner the” should read -- toner and the --; and
Line 53, “become” should read -- becomes --.

Column 30,
Line 1, “case” should read -- the case --;
Line 5, “same” should read -- the same --; and
Line 48, “cuased” should read -- caused --.

UNITED STATES PATENT AND TRADEMARK OFFICE

CERTIFICATE OF CORRECTION

PATENT NO. : 6,496,673 B2
DATED : December 17, 2002
INVENTOR(S) : Yuji Bessho

It is certified that error appears in the above-identified patent and that said Letters Patent is hereby corrected as shown below:

Column 31,
Line 8, "are" should be deleted.

Signed and Sealed this

Eleventh Day of November, 2003

JAMES E. ROGAN
*Director of the United States Patent and Trademark Office*